US006408953B1

(12) United States Patent
Goldman et al.

(10) Patent No.: US 6,408,953 B1
(45) Date of Patent: Jun. 25, 2002

(54) METHOD AND SYSTEM FOR PREDICTING PERFORMANCE OF A DRILLING SYSTEM FOR A GIVEN FORMATION

(75) Inventors: William A. Goldman, Houston; Oliver Matthews, III, Spring; William W. King, Houston; Gary E. Weaver, Conroe; Gerald L. Pruitt, Houston, all of TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 23 days.

(21) Appl. No.: 09/649,495

(22) Filed: Aug. 28, 2000

Related U.S. Application Data

(63) Continuation-in-part of application No. 09/192,389, filed on Nov. 13, 1998, now Pat. No. 6,109,368, which is a continuation-in-part of application No. 09/048,360, filed on Mar. 26, 1998, now Pat. No. 6,131,673, which is a continuation-in-part of application No. 08/621,411, filed on Mar. 25, 1996, now Pat. No. 5,794,720.

(51) Int. Cl.[7] ..... E21B 47/00; E21B 44/00

(52) U.S. Cl. ..... 175/39; 175/40; 175/57; 702/9

(58) Field of Search ..... 175/39, 40, 57, 175/24; 702/9

(56) References Cited

U.S. PATENT DOCUMENTS

| | | | | |
|---|---|---|---|---|
| 3,593,807 A | * | 7/1971 | Klima | 173/6 |
| 3,752,966 A | * | 8/1973 | Foy et al. | 175/40 |
| 3,971,449 A | * | 7/1976 | Nylund et al. | 173/11 |
| 4,064,749 A | * | 12/1977 | Pittman et al. | 73/152 |

(List continued on next page.)

FOREIGN PATENT DOCUMENTS

| | | | |
|---|---|---|---|
| EP | 0466255 A2 | * | 1/1992 |
| RU | 470593 | * | 8/1975 |
| RU | 726295 | * | 4/1980 |
| RU | 1716112 | * | 2/1992 |

OTHER PUBLICATIONS

E.M. Galle and H.B. Woods, "Best Constant Weight And Rotary Speed For Rotary Rock Bits", pp. 48–73, API Drilling and Production Practice, 1963.*

R. Teale, "The Concept Of Specific Energy In Rock Drilling", p. 57–63, International Journal of Rock Mechanics, Mining Sciences, vol. 2, 1965, Great Britain.*

Howell Word and Marvin Fisbeck, "Drilling Parameters And The Journal Bearing Carbide Bit", pp. 92–93, Drilling—DCW, Jan. 1980, first published Oct. 1979 in Tulsa, Oklahoma.*

R.C. Pessier, M.J. Fear, "Quantifying Common Drilling Problems With Mechanical Specific Energy and A Bit–Specific Coefficient Of Sliding Friction", pp. 373–388, SPE Paper 24584, published Oct. 1982, Washington, D.C.*

(List continued on next page.)

*Primary Examiner*—Hoang Dang
(74) *Attorney, Agent, or Firm*—Haynes and Boone, LLP

(57) ABSTRACT

A method and apparatus for predicting the performance of a drilling system for the drilling of a well bore in a given formation includes generating a geology characteristic of the formation per unit depth according to a prescribed geology model, obtaining specifications of proposed drilling equipment for use in the drilling of the well bore, and predicting a drilling mechanics in response to the specifications as a function of the geology characteristic per unit depth according to a prescribed drilling mechanics model. Responsive to a predicted drilling mechanics, a controller controls a parameter in the drilling of the well bore. The geology characteristic includes at least rock strength. The specifications include at least a bit specification of a recommended drill bit. Lastly, the predicted drilling mechanics include at least one of bit wear, mechanical efficiency, power, and operating parameters. A display is provided for generating a display of the geology characteristic and predicted drilling mechanics per unit depth, including either a display monitor or a printer.

50 Claims, 8 Drawing Sheets

U.S. PATENT DOCUMENTS

| | | | | | |
|---|---|---|---|---|---|
| 4,195,699 | A | * | 4/1980 | Rogers et al. | 173/177 |
| 4,354,233 | A | * | 10/1982 | Zhukovsky et al. | 173/6 |
| 4,407,017 | A | * | 9/1983 | Zhilikov et al. | 173/6 |
| 4,627,276 | A | * | 12/1986 | Burgess et al. | 175/39 |
| 4,685,329 | A | * | 8/1987 | Burgess | 175/39 |
| 4,694,686 | A | * | 9/1987 | Fildes et al. | 324/71.1 |
| 4,793,421 | A | * | 12/1988 | Jasinski | 173/11 |
| 4,845,628 | A | * | 7/1989 | Gray et al. | 702/9 |
| 4,875,530 | A | * | 10/1989 | Frink et al. | 175/27 |
| 4,914,591 | A | * | 4/1990 | Warren et al. | 175/40 |
| 4,926,686 | A | * | 5/1990 | Fay | 175/39 |
| 4,981,037 | A | * | 1/1991 | Holbrook et al. | 166/250.07 |
| 5,010,789 | A | * | 4/1991 | Brett et al. | 700/159 |
| 5,012,674 | A | * | 5/1991 | Millheim et al. | 324/201 |
| 5,216,917 | A | * | 6/1993 | Detournay | 175/39 |
| 5,282,384 | A | * | 2/1994 | Holbrook | 702/12 |
| 5,305,836 | A | * | 4/1994 | Holbrook et al. | 175/26 |
| 5,415,030 | A | * | 5/1995 | Jogi et al. | 175/39 |
| 5,442,950 | A | * | 8/1995 | Unalmiser et al. | 73/152.05 |
| 5,449,047 | A | * | 9/1995 | Schivley, Jr. | 173/11 |
| 5,458,207 | A | * | 10/1995 | Mattero | 173/6 |
| 5,704,436 | A | * | 1/1998 | Smith et al. | 173/6 |
| 5,767,399 | A | * | 6/1998 | Smith et al. | 702/10 |
| 5,965,810 | A | * | 10/1999 | Holbrook | 166/254.1 |
| 6,021,859 | A | * | 2/2000 | Tibbitts et al. | 175/431 |
| 6,109,368 | A | * | 8/2000 | Goldman et al. | 175/39 |

OTHER PUBLICATIONS

Michael A. Simpson, Sr., "Hand–Held Calculator Program Helps Optimize Drilling", pp. 97–101, World Oil, Apr. 1984.*

Kenneth L. Mason, "3–Cone Bit Selection With Sonic Logs", pp. 135–142, SPE Drilling Engineering, Jun. 1987, first published Sep. 1984 in Houston, Texas.*

Allen D. Gault, "Measurement of Drilling Properties", pp. 143–148, SPE Drilling Engineer, Jun. 1987, published New Orleans, Lousiana, Mar. 1985.*

T.M. Burgess, W.C. Lesso, "Measuring The Wear Of Milled Tooth Bits Using MWD Torque And Weight–On–Bit", SPE/IADC 13475, pp. 453–458 for pages illustration, published Mar. 1985, New Orleans, Louisiana.*

Philip Holbrook, Michael Hauck, "Petrophysical—Mecahnical Math Model Real–Time Wellsite Poor Pressure/Fracture Gradient Prediction", SPE Pub. No. 16666, published Sep. 1987 in Dallas, Texas.*

E.C. Onyia, "Relationships between Formation Strength, Drilling Strength, and Electric Log Properties", pp. 605–618, SPE Drilling Engineering, Oct., 1988.*

David A. Glowka, "Use of Single–Cutter Data in the Analysis of PDC Bit Designs: Part I—Development of a PDC Cutting Force Model", pp. 797–849, JPT, Aug. 1989.*

David A. Glowka, "Use of Single–Cutter Data in the Analysis of PDC Bit Designs: Part II—Development of PDC WEAR Computer Code", pp. 850–859, JPT, Aug. 1989.*

E. Detournay, P. Defourny, "A Phenomenological Model for the Drilling Action of Drag Bits", pp. 13–23, International Journal of Rock Mechanics, Mineral Sciences and Geomechanical Abstracts, vol. 29, No. 1, 1992, printed in Great Britain.*

Joe Kelly, Jr., "Use break–Even Analysis to Optimize Bit Runs", pp. 75–79, World Oil, Nov. 1992.*

Geir Hareland and L.L. Hoberock, "Use of Drilling Parameters to Predict In–Situ Stress Bounds", pp.457–471, SPE/IADC 25727, Feb. 1993.*

J.P.R. Sparr and L.W. Ledgerwood, harvey Goodman, R.L. Graff and T.J. Moo, "Formation Compressive Strength Estimates for Predicting Drillability and PDC Bit Selection", pp. 569–578, SPE/IADC 29397, published Feb. 1995, Amsterdam, Netherlands.*

R.V. Barragan, O.L.A. Santos and E.E. Maidla, "Optimization of Multiple Bit Runs", pp. 579–589, SPE/IADC 37644, Mar. 4, 1977.*

R.K. Bratli, G. Hareland, F. Stene, G.W. Dunsaed and G. Gjelstad, "Drilling Optimization Software Verified in the North Sea", 7 pages, SPE 39007, Aug. 1997.*

G. Gjelstad, G. Hareland, K.N. Nikolaisen and R.K. Bratli, "The Method of Reducing Drilling Costs More Than 50 Percent", 7 pages, SPE 47342, Jul. 1998.*

M.B. Ziaja and J.C. Roegiers, "Lithology Diagnosis Based on the Measurements of Drilling Forces and Moments at the Bit", IADC/SPE 47799, pp. 185–194, Sep. 1998.*

H. Xu, T. Hatakeyama, T. Yonezawa and A. Suzuki, "Evaluation of Bit Performance Using an Advanced Drilling–Test System", IADC/SPE 47809, pp. 247–252, Sep. 1998.

H.I. Bilgesu, U. Altmis, S. Ameri, S. Mohaghegh andK. Aminian, "A New Approach to Predict Life Based on Tooth or Bearing Failures", pp. 253–257, SPE 51082, Nov. 1998.

E.T. Koskie, Jr., P.Slagel and W. Lesso, Jr., "Monitoring MWD Torque Improved PDC Bit Penetration Rates", pp. 61–67, World Oil, 1998.

* cited by examiner

140

52
160
LITHOLOGY MODEL
146
162
148
150
142
164
ROCK STRENGTH MODEL
SHALE PLASTICITY MODEL
178
166
180
GEOLOGY MODELS
DRILLING MECHANICS MODELS
152
162
162
154
168
MECHANICAL EFFICIENCY MODEL
HOLE CLEANING EFFICIENCY (HCE) MODEL
182
176
166
170
162
172
144
BIT WEAR MODEL
156
184
166 162
174
170
180
186
PENETRATION RATE MODEL
158
188

200

202
DISPLAY OF PREDICTED PERFORMANCE OF DRILLING SYSTEM FOR A GIVEN FORMATION (PLOTS OF DATA VS. DEPTH)
214
GEOLOGY OF FORMATION
Log Data
Depth
Lithology
Porosity
Rock Strength
0 GR(API) 150
2 RHOB(g/cc) 3
140 DT(us/ft) 40
6 CAL(in) 16
MD(ft)
200
SS LS DOL COAL SH
0 ND-POR 0.5
0 N-POR 0.5
0 D-POR 0.5
0 S-POR 0.5
0 CCS(psi) 50000
0 UCS(psi) 50000
0 CORE(psi) 50000
ROCK CCS
450
500
550
600
650
700
222
220
224
280
1350
1400
1450
TO FIG. 4B
208
206
210
212
216
218

200

DISPLAY OF PREDICTED PERFORMANCE OF DRILLING SYSTEM FOR A GIVEN FORMATION (PLOTS OF DATA VS. DEPTH)
202
204
GEOLOGY OF FORMATION
PREDICTED PERFORMANCE OF DRILLING SYSTEM
228
Shale Plasticity
Bit Wear
Mechanical Efficiency
234
244
0 PLASTICITY 1
0 CEC-N 1
0 CBW-N 1
0 Vsh-N 1
PLASTICITY
1 ABRASIV(t*mi) 10000
1 WORK(t*mi) 10000
1 SP ENERGY(ksi) 1000
Bit Wear
0 100
0 TOB-CUT(ft*lb) 4000
0 TOB(ft*lb) 4000
Mech. Effic.
0 100
Mech. Effic. Const.
0 100
250
252
254
242
240
280
FROM FIG. 4A
TO FIG. 4C
230
232
236
238
246
248
256

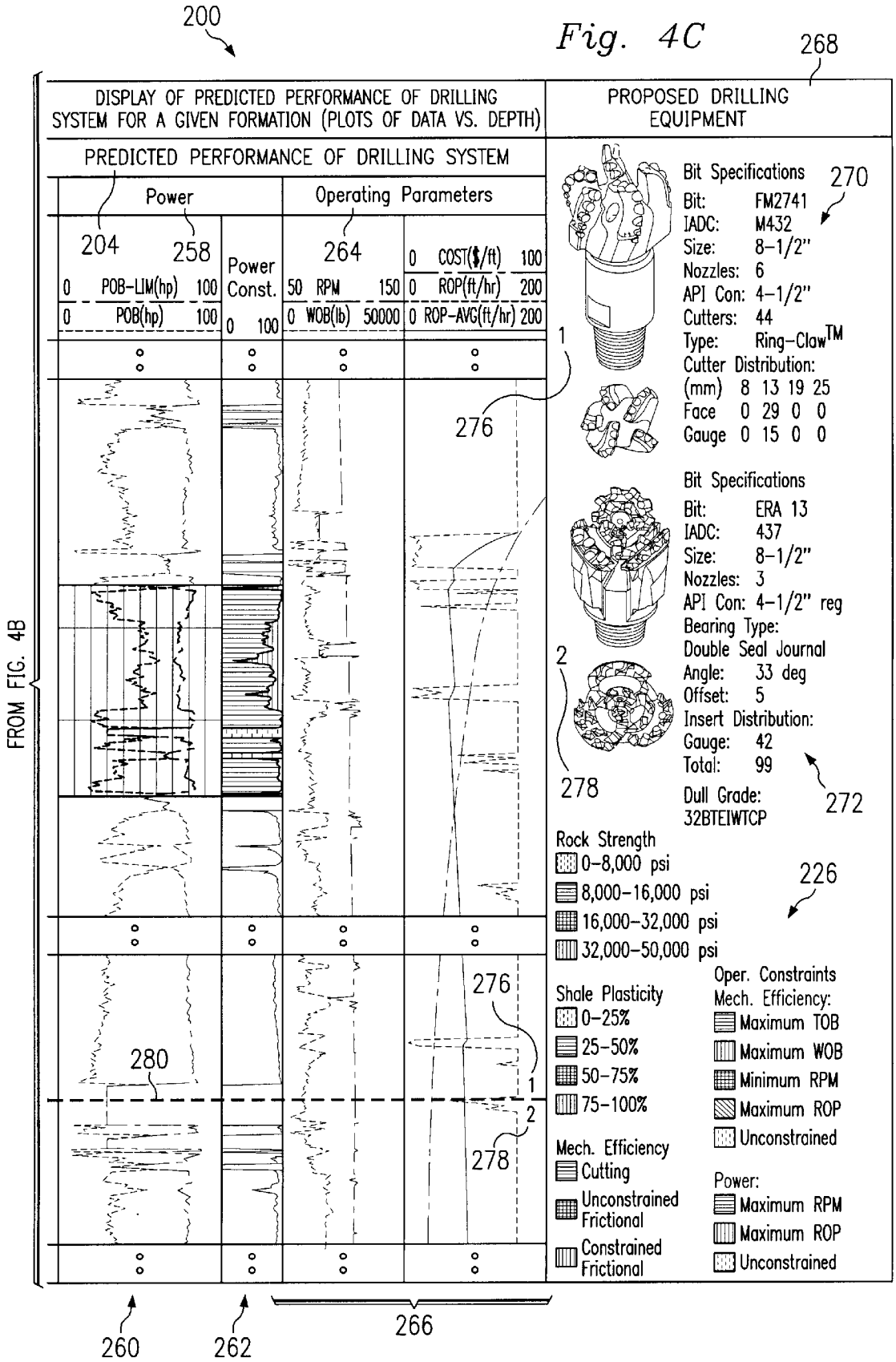
200
Fig. 4C
268
DISPLAY OF PREDICTED PERFORMANCE OF DRILLING SYSTEM FOR A GIVEN FORMATION (PLOTS OF DATA VS. DEPTH)
PROPOSED DRILLING EQUIPMENT
PREDICTED PERFORMANCE OF DRILLING SYSTEM
Power
Operating Parameters
204
258
264
0 POB-LIM(hp) 100
0 POB(hp) 100
Power Const.
0 100
50 RPM 150
0 WOB(lb) 50000
0 COST($/ft) 100
0 ROP(ft/hr) 200
0 ROP-AVG(ft/hr) 200
FROM FIG. 4B
276
280
278
1
2
260
262
266
Bit Specifications
270
Bit: FM2741
IADC: M432
Size: 8-1/2"
Nozzles: 6
API Con: 4-1/2"
Cutters: 44
Type: Ring-Claw™
Cutter Distribution:
(mm) 8 13 19 25
Face 0 29 0 0
Gauge 0 15 0 0
Bit Specifications
Bit: ERA 13
IADC: 437
Size: 8-1/2"
Nozzles: 3
API Con: 4-1/2" reg
Bearing Type:
Double Seal Journal
Angle: 33 deg
Offset: 5
Insert Distribution:
Gauge: 42
Total: 99
Dull Grade:
32BTEIWTCP
272
Rock Strength
0-8,000 psi
8,000-16,000 psi
16,000-32,000 psi
32,000-50,000 psi
226
Shale Plasticity
0-25%
25-50%
50-75%
75-100%
Mech. Efficiency
Cutting
Unconstrained Frictional
Constrained Frictional
Oper. Constraints
Mech. Efficiency:
Maximum TOB
Maximum WOB
Minimum RPM
Maximum ROP
Unconstrained
Power:
Maximum RPM
Maximum ROP
Unconstrained

METHOD AND SYSTEM FOR PREDICTING PERFORMANCE OF A DRILLING SYSTEM FOR A GIVEN FORMATION

CROSS REFERENCE TO CO-PENDING APPLICATION(S)

This application is a continuation-in-part of U.S. patent application Ser. No. 09/192,389, filed on Nov. 13, 1998, now U.S Pat. No. 6,109,368, which is a continuation-in-part of U.S. patent application Ser. No. 09/048,360, filed on Mar. 26, 1998, now U.S. Pat. No. 6,131,673, which is a continuation-in-part of U.S. patent application Ser. No. 08/621,411, filed on Mar. 25, 1996, now U.S. Pat. No. 5,794,720. The co-pending application and issued patent are incorporated herein by reference in their entirety.

BACKGROUND OF THE INVENTION

1. Field of the Invention

The present invention is related to earth formation drilling operations, and more particularly, to methods and system apparatus for predicting performance of a drilling system for a given formation.

2. Discussion of the Related Art

From the very beginning of the oil and gas well drilling industry, as we know it, one of the biggest challenges has been the fact that it is impossible to actually see what is going on downhole. There are any number of downhole conditions and/or occurrences which can be of great importance in determining how to proceed with the operation. It goes without saying that all methods for attempting to assay such downhole conditions and/or occurrences are indirect. To that extent, they are all less than ideal, and there is a constant effort in the industry to develop simpler and/or more accurate methods.

In general, the approach of the art has been to focus on a particular downhole condition or occurrence and develop a way of assaying that particular condition or occurrence. For example, U.S. Pat. No. 5,305,836, discloses a method whereby the wear of a bit currently in use can be electronically modeled, based on the lithology of the hole being drilled by that bit. This helps a drilling operator determine when it is time to replace the bit.

The process of determining what type of bit to use in a given part of a given formation has, traditionally, been, at best, based only on very broad, general considerations, and at worst, more a matter of art and guess work than of science.

Other examples could be given for other kinds of conditions and/or occurrences.

Furthermore, there are still other conditions and/or occurrences which would be helpful to know. However, because they are less necessary, and in view of the priority of developing better ways of assaying those things which are more important, little or no attention has been given to methods of assaying these other conditions.

SUMMARY OF THE INVENTION

In accordance with one embodiment of the present disclosure, an apparatus for predicting the performance of a drilling system for the drilling of a well bore in a given formation includes a means for generating a geology characteristic of the formation per unit depth according to a prescribed geology model. The geology characteristic generating means is further for outputting signals representative of the geology characteristic, the geology characteristic including at least rock strength. The apparatus further includes a means for inputting specifications of proposed drilling equipment for use in the drilling of the well bore. The specifications include at least a bit specification of a recommended drill bit. Lastly, the apparatus further includes a means for determining a predicted drilling mechanics in response to the specifications of the proposed drilling equipment as a function of the geology characteristic per unit depth according to a prescribed drilling mechanics model. The predicted drilling mechanics determining means is further for outputting signals representative of the predicted drilling mechanics. The predicted drilling mechanics include at least one of the following selected from the group consisting of bit wear, mechanical efficiency, power, and operating parameters.

In another embodiment, the apparatus further includes a means responsive to the geology characteristic output signals and the predicted drilling mechanics output signals for generating a display of the geology characteristic and predicted drilling mechanics per unit depth. The display generating means includes either a display monitor or a printer. In the instance of the printer, the display of the geology characteristic and predicted drilling mechanics per unit depth includes a printout.

In another embodiment, a method for predicting the performance of a drilling system for the drilling of a well bore in a given formation includes the steps of a) generating a geology characteristic of the formation per unit depth according to a prescribed geology model and outputting signals representative of the geology characteristic, the geology characteristic including at least rock strength; b) obtaining specifications of proposed drilling equipment for use in the drilling of the well bore, the specifications including at least a bit specification of a recommended drill bit; and c) determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters.

In yet another embodiment, a computer program stored on a computer-readable medium for execution by a computer for predicting the performance of a drilling system in the drilling of a well bore of a given formation includes a) instructions for generating a geology characteristic of the formation per unit depth according to a prescribed geology model and outputting signals representative of the geology characteristic, the geology characteristic including at least rock strength; b) instructions for obtaining specifications of proposed drilling equipment for use in the drilling of the well bore, the specifications including at least a bit specification of a recommended drill bit; and c) instructions for determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters.

Still further, in another embodiment, a display of predicted performance of a drilling system suitable for use as guidance in the drilling of a well bore in a given formation is disclosed. The display includes a geology characteristic of the formation per unit depth, the geology characteristic having been obtained according to a prescribed geology model and includes at least rock strength. The display further includes specifications of proposed drilling equipment for use in the drilling of the well bore. The specifications include at least a bit specification of a recommended drill bit. Lastly, the display includes a predicted drilling mechanics, the predicted drilling mechanics having been determined in response to said specifications of the proposed drilling equipment as a function of the geology characteristic per unit depth according to a prescribed drilling mechanics model. The predicted drilling mechanics include at least one of the following selected from the group consisting of bit wear, mechanical efficiency, power, and operating parameters.

Further with respect to the display of the predicted performance, the geology characteristic further includes at least one graphical representation selected from the group consisting of a curve representation, a percentage graph representation, and a band representation, and the display of the predicted drilling mechanics includes at least one graphical representation selected from the group consisting of a curve representation, a percentage graph representation, and a band representation.

The present embodiments advantageously provide for an evaluation of various proposed drilling equipment prior to and during an actual drilling of a well bore in a given formation, further for use with respect to a drilling program. Drilling equipment, its selection and use, can be optimized for a specific interval or intervals of a well bore in a given formation. The drilling mechanics models advantageously take into account the effects of progressive bit wear through changing lithology. Recommended operating parameters reflect the wear condition of the bit in the specific lithology and also takes into account the operating constraints of the particular drilling rig being used. A printout or display of the geology characteristic and predicted drilling mechanics per unit depth for a given formation provides key information which is highly useful for a drilling operator, particularly for use in optimizing the drilling process. The printout or display further advantageously provides a heads up view of expected drilling conditions and recommended operating parameters.

BRIEF DESCRIPTION OF THE DRAWINGS

The foregoing and other teachings and advantages of the present invention will become more apparent upon a detailed description of the best mode for carrying out the invention as rendered below. In the description to follow, reference will be made to the accompanying drawings, in which.

DETAILED DESCRIPTION OF THE PREFERRED EMBODIMENTS

Figure 1:
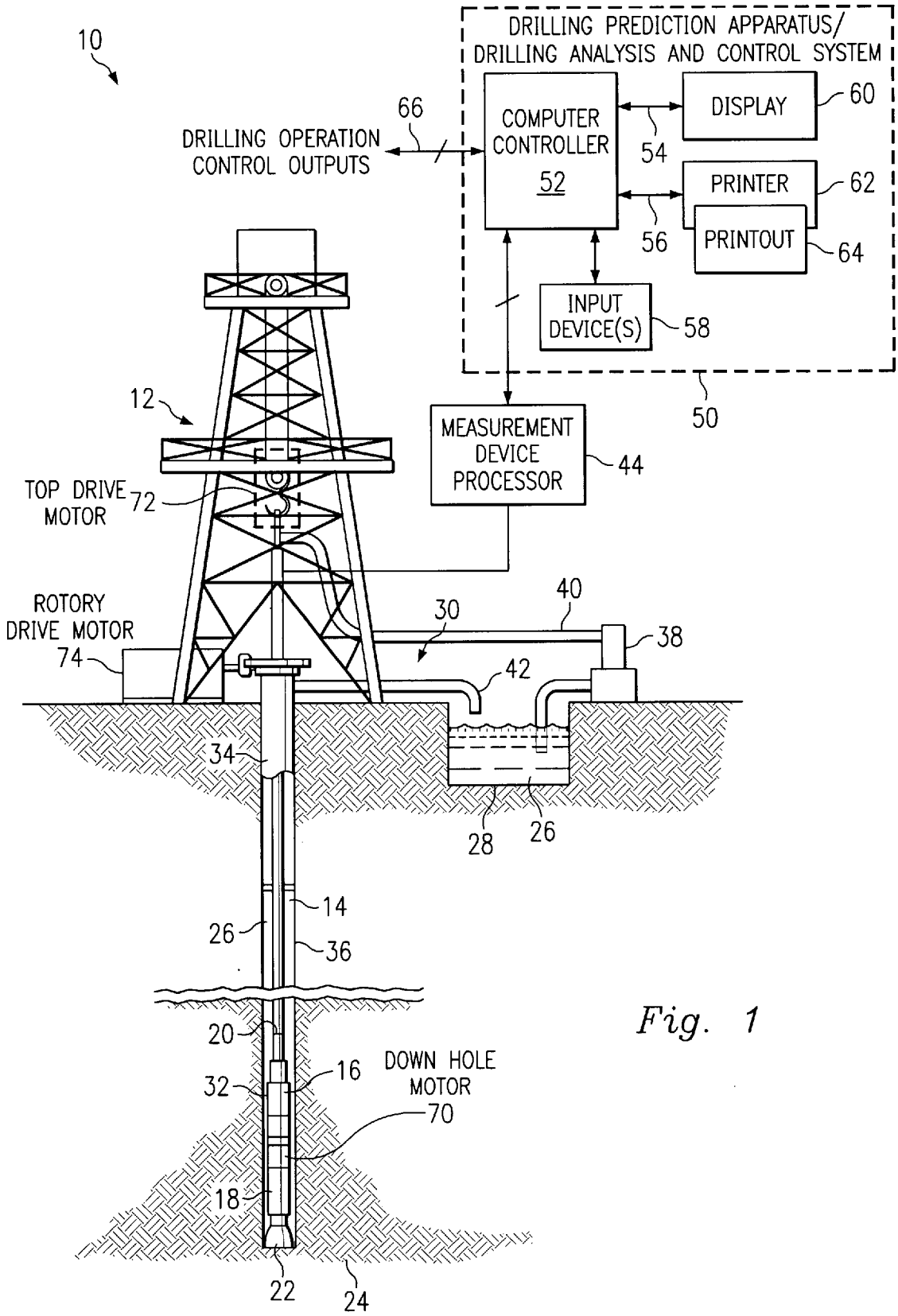
FIG. 1 illustrates a drilling system including an apparatus for predicting the performance of the drilling system for the drilling of a well bore or well bores according to a prescribed drilling program in a given formation.

Referring now to FIG. 1, a drilling system 10 includes a drilling rig 12 disposed atop a borehole 14. A logging tool 16 is carried by a sub 18, typically a drill collar, incorporated into a drill string 20 and disposed within the borehole 14. A drill bit 22 is located at the lower end of the drill string 20 and carves a borehole 14 through the earth formations 24. Drilling mud 26 is pumped from a storage reservoir pit 28 near the wellhead 30, down an axial passageway (not illustrated) through the drill string 20, out of apertures in the bit 22 and back to the surface through the annular region 32. Metal casing 34 is positioned in the borehole 14 above the drill bit 22 for maintaining the integrity of an upper portion of the borehole 14.

With reference still to FIG. 1, the annular 32 between the drill stem 20, sub 18, and the sidewalls 36 of the borehole 14 forms the return flow path for the drilling mud. Mud is pumped from the storage pit near the well head 30 by pumping system 38. The mud travels through a mud supply line 40 which is coupled to a central passageway extending throughout the length of the drill string 20. Drilling mud is, in this manner, forced down the drill string 20 and exits into the borehole through apertures in the drill bit 22 for cooling and lubricating the drill bit and carrying the formation cuttings produced during the drilling operation back to the surface. A fluid exhaust conduit 42 is connected from the annular passageway 32 at the well head for conducting the return mud flow from the borehole 14 to the mud pit 28. The drilling mud is typically handled and treated by various apparatus (not shown) such as out gassing units and circulation tanks for maintaining a preselected mud viscosity and consistency.

The logging tool or instrument 16 can be any conventional logging instrument such as acoustic (sometimes referred to as sonic), neutron, gamma ray, density, photoelectric, nuclear magnetic resonance, or any other conventional logging instrument, or combinations thereof, which can be used to measure lithology or porosity of formations surrounding an earth borehole.

Because the logging instrument is embodied in the drill string 20 in FIG. 1, the system is considered to be a measurement while drilling (MWD) system, i.e., it logs while the drilling process is underway. The logging data can be stored in a conventional downhole recorder (not illustrated), which can be accessed at the earth's surface when the drill sting 20 is retrieved, or can be transmitted to the earth's surface using telemetry such as the conventional mud pulse telemetry systems. In either event, the logging data from the logging instrument 16 eventually reaches a surface measurement device processor 44 to allow the data to be processed for use in accordance with the embodiments of the present disclosure as described herein. That is, processor 44 processes the logging data as appropriate for use with the embodiments of the present disclosure.

In addition to MWD instrumentation, wireline logging instrumentation may also be used. That is, wireline logging instrumentation may also be used for logging the formations surrounding the borehole as a function of depth. With wireline instrumentation, a wireline truck (not shown) is typically situated at the surface of a well bore. A wireline logging instrument is suspended in the borehole by a logging cable which passes over a pulley and a depth measurement sleeve. As the logging instrument traverses the borehole, it logs the formations surrounding the borehole as a function of depth. The logging data is transmitted through a logging cable to a processor located at or near the logging truck to process the logging data as appropriate for use with the embodiments of the present disclosure. As with the MWD embodiment of FIG. 1, the wireline instrumentation may include any conventional logging instrumentation which can be used to measure the lithology and/or porosity of formations surrounding an earth borehole, for example, such as acoustic, neutron, gamma ray, density, photoelectric, nuclear magnetic resonance, or any other conventional logging instrument, or combinations thereof, which can be used to measure lithology.

Referring again still to FIG. 1, an apparatus 50 for predicting the performance of the drilling system 10 for drilling a series of well bores, such as well bore 14, in a given formation 24 is shown. The prediction apparatus 50 includes a prescribed set of geology and drilling mechanics models and further includes optimization, prediction, and calibration modes of operation (to be discussed further herein below with reference to FIG. 3). The prediction apparatus 50 further includes a device 52 includes any suitable commercially available computer, controller, or data processing apparatus, further being programmed for carrying out the method and apparatus as further described herein. Computer/controller 52 includes at least one input for receiving input information and/or commands, for instance, from any suitable input device (or devices) 58. Input device (devices) 58 may include a keyboard, keypad, pointing device, or the like, further including a network interface or other communications interface for receiving input information from a remote computer or database. Still further, computer/controller 52 includes at least one output for outputting information signals and/or equipment control commands. Output signals can be output to a display device 60 via signal lines 54 for use in generating a display of information contained in the output signals. Output signals can also be output to a printer device 62 for use in generating a printout 64 of information contained in the output signals. Information and/or control signals may also be output via signal lines 66 as necessary, for example, to a remote device for use in controlling one or more various drilling operating parameters of drilling rig 12, further as discussed herein. In other words, a suitable device or means is provided on the drilling system which is responsive to a predicted drilling mechanics output signal for controlling a parameter in an actual drilling of a well bore (or interval) with the drilling system. For example, drilling system may include equipment such as one of the following types of controllable motors selected from a down hole motor 70, a top drive motor 72, or a rotary table motor 74, further in which a given rpm of a respective motor may be remotely controlled. The parameter may also include one or more of the following selected from the group of weight-on-bit, rpm, mud pump flow rate, hydraulics, or any other suitable drilling system control parameter.

Computer/controller 52 provides a means for generating a geology characteristic of the formation per unit depth in accordance with a prescribed geology model. Computer/controller 52 further provides for outputting signals on signal lines 54,56 representative of the geology characteristic. Input device 58 can be used for inputting specifications of proposed drilling equipment for use in the drilling of the well bore (or interval of the well bore). The specifications include at least a bit specification of a recommended drill bit. Computer/controller 52 further provides a means for determining a predicted drilling mechanics in response to the specifications of the proposed drilling equipment as a function of the geology characteristic per unit depth, further in accordance with a prescribed drilling mechanics model. Computer/controller 52 still further provides for outputting signals on signal lines 54,56 representative of the predicted drilling mechanics.

Computer/controller 52 is programmed for performing functions as described herein, using programming techniques known in the art. In one embodiment, a computer readable medium is included, the computer readable medium having a computer program stored thereon. The computer program for execution by computer/controller 52 is for predicting the performance of a drilling system in the drilling of a well bore of a given formation. The computer program includes instructions for generating a geology characteristic of the formation per unit depth according to a prescribed geology model and outputting signals representative of the geology characteristic, the geology characteristic including at least rock strength. The computer program also includes instructions for obtaining specifications of proposed drilling equipment for use in the drilling of the well bore, the specifications including at least a bit specification of a recommended drill bit. Lastly, the computer program includes instructions for determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters. The programming of the computer program for execution by computer/controller 52 may further be accomplished using known programming techniques for implementing the embodiments as described and discussed herein. Thus, a geology of the given formation per unit depth can be generated, and in addition a predicted drilling mechanics performance of a drilling system may be determined. Still further, the drilling operation can be advantageously optimized in conjunction with a knowledge of a predicted performance thereof, as discussed further herein below.

In a preferred embodiment, the geology characteristic includes at least rock strength. In an alternate embodiment, the geology characteristic may further include any one or more of the following which include log data, lithology, porosity, and shale plasticity.

As mentioned above, input device 58 can be used for inputting specifications of proposed drilling equipment for use in the drilling of the well bore (or interval of the well bore). In a preferred embodiment, the specifications include at least a bit specification of a recommended drill bit. In an alternate embodiment, the specifications may also include one or more specifications of the following equipment which may include down hole motor, top drive motor, rotary table motor, mud system, and mud pump. Corresponding specifications may include a maximum torque output, a type of mud, or mud pump output rating, for example, as would be appropriate with respect to a particular drilling equipment.

In a preferred embodiment, the predicted drilling mechanics include at least one of the following drilling mechanics selected from the group consisting of bit wear, mechanical efficiency, power, and operating parameters. In another embodiment, the operating parameters can include weight-on-bit, rotary rpm (revolutions-per-minute), cost, rate of penetration, and torque, to be further discussed herein below. The rate of penetration further includes an instantaneous rate of penetration (ROP) and an average rate of penetration (ROP-AVG).

Figure 2A:
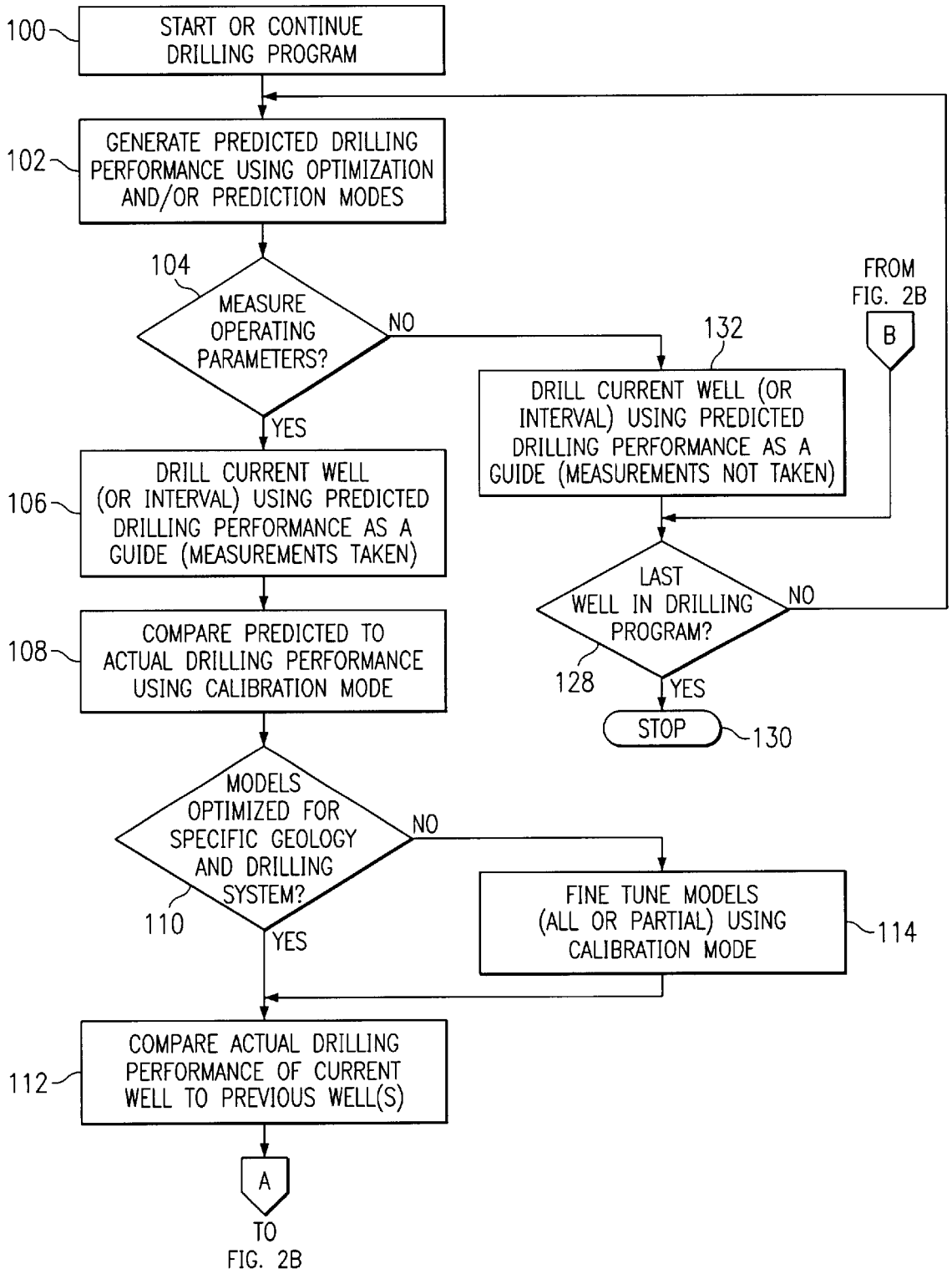
FIG. 2 illustrates a method for optimizing a drilling system and its use for the drilling of a well bore or well bores according to a prescribed drilling program in a given formation, the method further including predicting the performance of the drilling system.
Figure 2B:
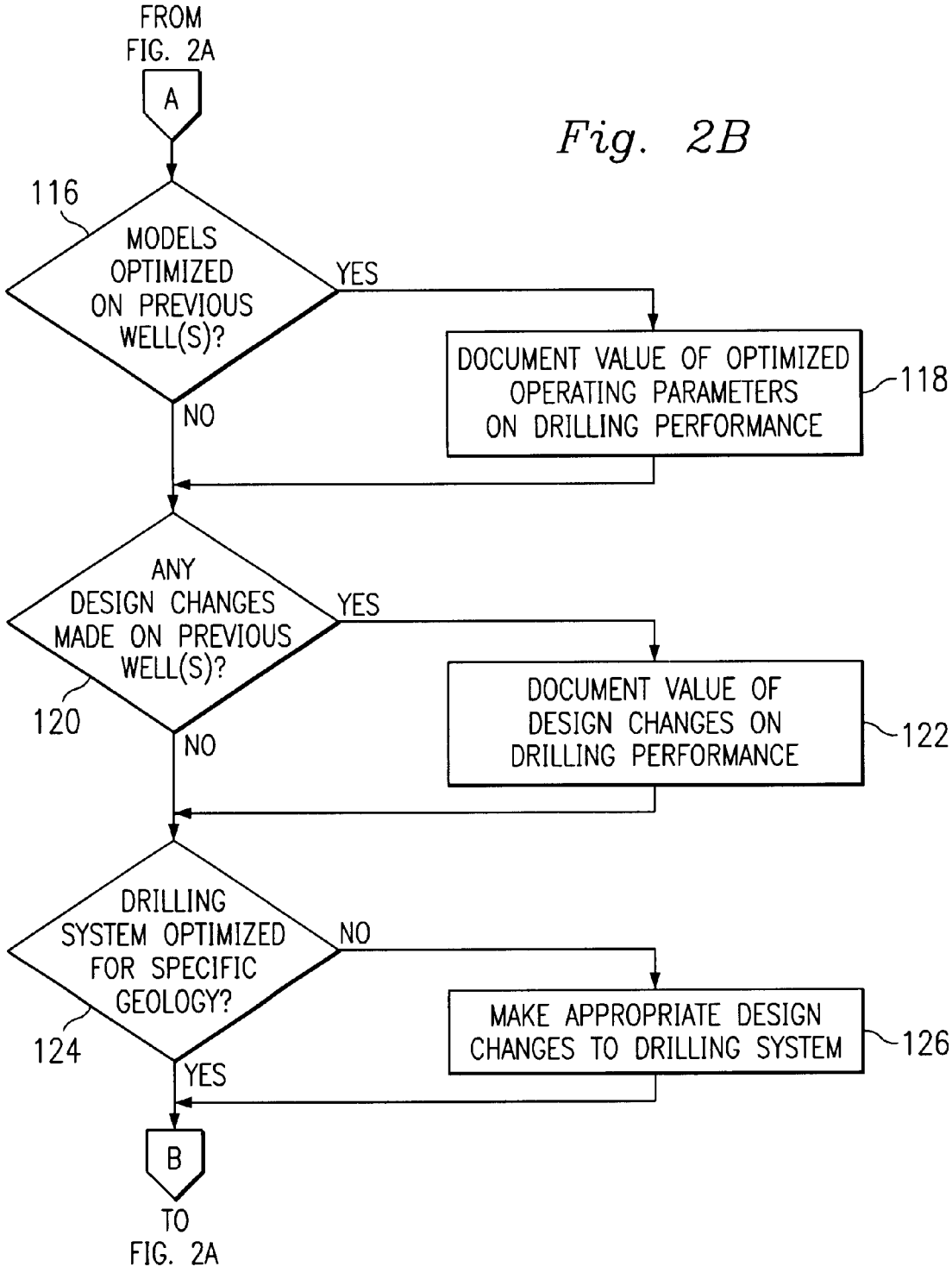

Referring now to FIG. 2, a flow diagram illustrating a method for drilling of a series of well bores in a given formation with the use of the apparatus 50 for predicting the performance of a drilling system shall now be discussed. The method is for optimizing both the drilling system and its use in a drilling program, further in conjunction with the drilling of one or more well bores (or intervals of a well bore) in the given formation. In step 100, the method includes the start of a particular drilling program or a continuation of a drilling program for the given formation. With respect to a continuation of the drilling program, it may be that the drilling program is interrupted for some reason, for example, due to equipment failure or down time, and as a result, the drilling program is only partially completed. Upon a repair or replacement of failed equipment, the method of the present disclosure can again be initiated at step 100. Note that the method of the present disclosure can be implemented at any point during a given drilling program for optimizing the particular drilling system and its use, preferably being implemented from the start of a given drilling program.

In step 102, a predicted drilling performance of the drilling system for the drilling of a well bore in the given formation is generated in accordance with the present disclosure. In addition, the predicted drilling performance for drilling of a given well bore is generated in accordance with a prescribed set of geology and drilling mechanics prediction models using at least one of the following modes selected from the group consisting of an optimization mode and a prediction mode. In other words, in the generation of the predicted drilling performance of the drilling system, either the optimization mode and/or the prediction mode may be used. The predicted drilling performance includes predicted drilling mechanics measurements. The optimization mode and the prediction mode shall be discussed further herein below, with respect to FIG. 3.

In step 104, the drilling operator makes a decision whether or not to obtain actual drilling mechanics measurements during the drilling of the given well bore (or interval of well bore). In step 106, if actual drilling mechanics measurements (e.g., operating parameters) are to be obtained, then the given well bore (or interval) is drilled with the drilling system using the predicted drilling performance as a guide. Furthermore, in step 106, during the drilling of the well bore (or interval), actual drilling mechanics measurements are taken. Alternatively, if the decision is not to obtain a measurement of operating parameters during the drilling of a given well bore (or interval of well bore), then the method proceeds to step 132, as will be discussed further herein below.

Figure 3:
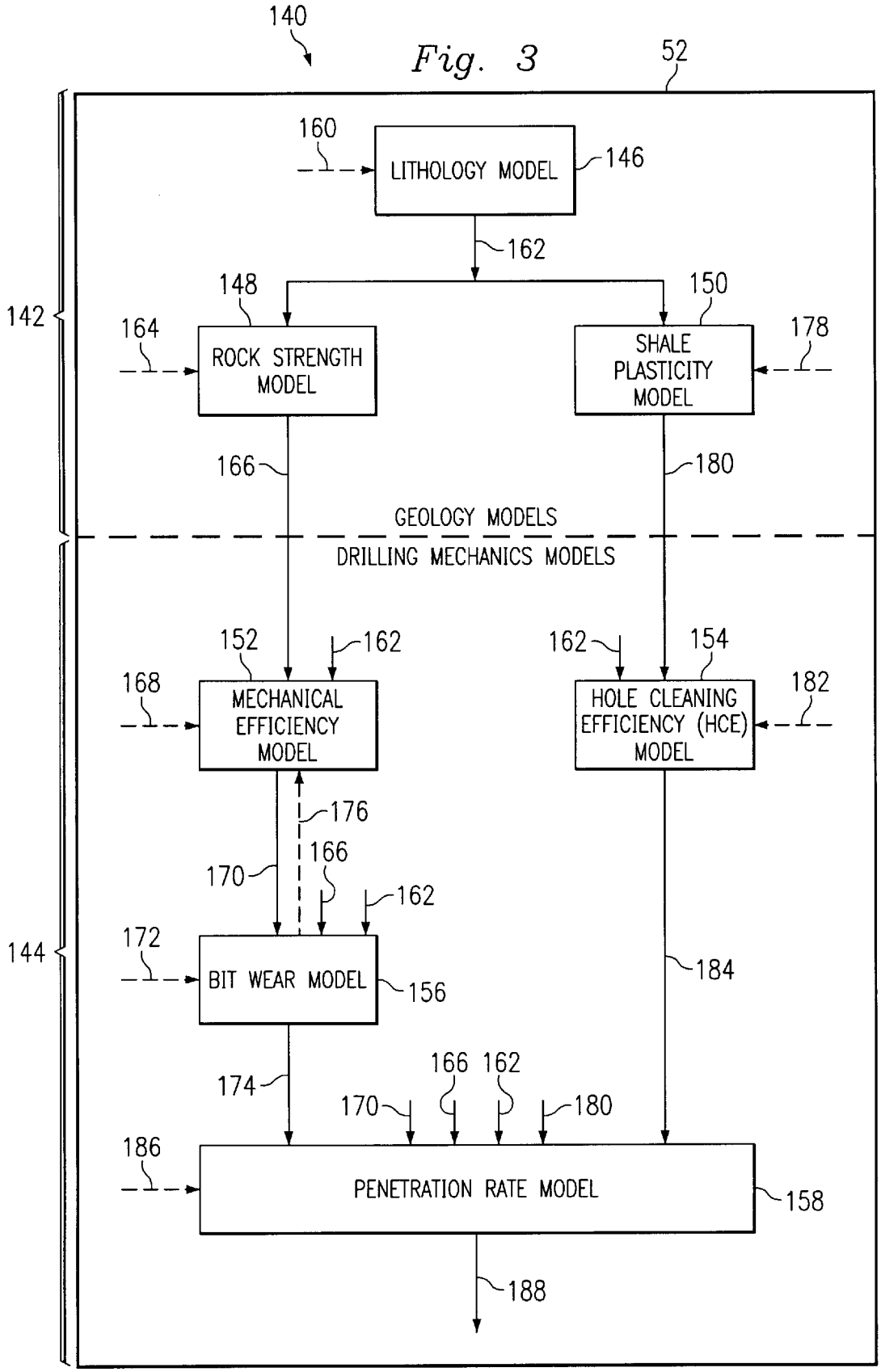
FIG. 3 illustrate geology and drilling mechanics models for use in the embodiments of the drilling performance prediction method and apparatus of the present disclosure.

In step 108, the predicted drilling performance is compared with the actual drilling performance, using a calibration mode of operation, wherein the calibration mode of operation shall be discussed further herein with reference to FIG. 3. In the comparison, actual drilling mechanics measurements are compared to predicted drilling mechanics measurements. The comparison process preferably includes overlaying a plot of the actual performance over the predicted performance (or vice versa) for visually determining any deviations between actual and predicted performance. The comparison may also be implemented with the assistance of a computer for comparing appropriate data.

With reference now to step 110 of FIG. 2, step 110 includes an inquiry of whether or not the prescribed geology and drilling mechanics models are optimized for the specific geology and drilling system. In other words, if the models are optimized for the specific geology and the specific drilling system, then the comparison of the actual drilling mechanics measurements to the predicted drilling mechanics measurements is acceptable. The method then proceeds to the step 112, in conjunction with the drilling of a subsequent well bore in the series of well bores. On the other hand, if the models are not optimized for the specific geology and drilling system, then from step 110 the method proceeds to step 114. If the comparison of the actual drilling mechanics measurements to the predicted drilling mechanics measurements in step 108 is not acceptable, then at least one of the geology and drilling mechanics models is fine tuned using the calibration mode of operation. In step 114, the geology and drilling mechanics models are fined tuned (all or partial) using the calibration mode. Using the calibration mode, all or some of the geology and drilling mechanics models are fine tuned as appropriate, further as determined from the comparison of actual versus predicted drilling performance. Upon a fine tuning of models in step 114, the method proceeds to step 112, in conjunction with the drilling of a subsequent well bore in the series of well bores.

In step 112, the actual drilling performance of the current well is compared with an actual performance of a previous well (or previous wells). Such a comparison enables a determination of whether any improvement(s) in performance have occurred. For example, the comparison may reveal that the current well was drilled in eighteen (18) days versus twenty (20) days for a previous well. Subsequent to step 112, in step 116, an inquiry is made as to whether or not the geology and drilling mechanics models were optimized on a previous well or wells. If the models were optimized, then the method proceeds to step 118. Alternatively, if the models were not optimized on a previous well or wells, then the method proceeds to step 120.

In step 118, the value of the optimized operating parameters on drilling performance is documented. Furthermore, the value of the optimized operating parameters on drilling performance is documented and/or recorded in any suitable manner for easy access and retrieval. Documentation and/or recording may include, for example, a progress report, a computer file, or a database. Step 118 thus facilitates the capture of value of the optimization of operating parameters on drilling performance. Examples of value of optimization may include various benefits, for example, economic benefit of optimized drilling, fewer trips to the particular field being drilled, less time required to drill a well, or any other suitable value measurement, etc. To illustrate further with a simple example, assume that an off-shore drilling program costs on the order of one hundred fifty thousand dollars per day ($150,000/day) to run. A savings or reduction of two (2) days per well (as a result of optimization of the drilling system and its use) would equate to a savings of three hundred thousand dollars ($300,000) per well. For a drilling program of thirty (30) wells, the combined savings as a result of an optimization of could potentially be as much as nine million dollars ($9,000,000) for the given drilling program.

In step 120, an inquiry is made as to whether or not any design changes have been made on a previous well or wells. If design changes were made, then the method proceeds to step 122. In step 122, in a manner similar to step 118, the value of design changes on drilling performance is documented. That is, the value of the design changes on drilling performance is documented and/or recorded in any suitable manner for easy access and retrieval. Documentation and/or recording may include, for example, a progress report, a computer file, or a database. Step 122 thus facilitates the capture of value of the design changes on drilling performance. Alternatively, if no design changes were made on the previous well or wells, then the method proceeds to step 124.

In step 124, an inquiry is made as to whether or not the drilling system is optimized for the specific geology. For instance, in a current well, a particular drilling equipment constraint may be severely affecting drilling performance if the drilling system has not been optimized for the specific geology. For example, if a mud pump is inadequate for a given geology, then the resulting hydraulics may also be insufficient to adequately clean hole, thus adversely impacting the drilling performance of the drilling system for the specific geology. If the drilling system is not optimized for the specific geology, then the method proceeds to step 126, otherwise, the method proceeds to step 128. In step 126, appropriate design changes are implemented or made to the drilling system. The design change may include an equipment replacement, retrofit, and/or modification, or other design change as deemed appropriate for the particular geology. The drilling system equipment and its use can thus be optimized for drilling in the given geology. The method then proceeds to step 128.

In step 128, an inquiry is made as to whether or not the last well in the drilling program has been drilled. If the last well has been drilled, then the method ends at step 130. If the last well has not yet been drilled, then the method proceeds again to step 102, and the process continues as discussed herein above.

In step 132, if drilling system operating parameters are not to be obtained, then the given well bore (or interval) is drilled with the drilling system using the predicted drilling performance as a guide without measurements being taken. In step 132, during the drilling of the well bore (or interval), no drilling mechanics measurements are taken. Upon completion of the drilling of the current well (or interval) in step 132, the method then proceeds to step 128, and the process continues as discussed herein above.

The method and apparatus of the present disclosure advantageously enables an optimization of a drilling system and its use in a drilling program to be obtained early on in a given drilling program. For example, with the present method and apparatus, an optimization might be obtained within the first few wells of a thirty well program, wherein without the present method or apparatus, optimization might not be obtained until the fifteenth well of the thirty well program. The present method further facilitates making appropriate improvements early in the drilling program. Any economic benefits resulting from the improvements made early in the drilling program are advantageously multiplied by the number of wells remaining to be drilled in the drilling program. As a result, significant and substantial savings for a company commissioning the drilling program can be advantageously achieved. Measurements may be made during drilling of each well bore, all the way through a drilling program, using the present method and apparatus for the purpose of verifying that the particular drilling system equipment is being optimally used. In addition, drilling system equipment performance can be monitored more readily with the method and apparatus of the present disclosure, further for identifying potential adverse conditions prior to their actual occurrence.

With reference now to FIG. 3, a model of a total drilling system is provided by the prediction models 140. The prediction models include geology models 142 and drilling mechanics models 144, further in accordance with the present method and apparatus.

FIG. 3 illustrates an overview of the various prediction models 140 and how they are linked together. The prediction models 140 are stored in and carried out by computer/controller 52 of FIG. 1, further as discussed herein.

The geology models 142 include a lithology model 146, a rock strength model 148, and a shale plasticity model 150. The lithology model preferably includes a lithology model as described in U.S. Pat. No. 6,044,327, issued Mar. 28, 2000, entitled "METHOD FOR QUANTIFYING THE LITHOLOGIC COMPOSITION OF FORMATIONS SURROUNDING EARTH BOREHOLES," and incorporated herein by reference. The lithology model provides a method for quantifying lithologic component fractions of a given formation, including lithology and porosity. The lithology model utilizes any lithology or porosity sensitive log suite, for example, including nuclear magnetic resonance, photoelectric, neutron-density, sonic, gamma ray, and spectral gamma ray. The lithology model further provides an improved multi component analysis. For example, in the lithology column of FIG. 4, at 575 feet depth, four (4) components are shown which include sandstone, limestone, dolomite, and shale. Components can be weighted to a particular log or group of logs. The lithology model acknowledges that certain logs are better than others at resolving a given lithologic component. For instance, it is well known that the gamma ray log is generally the best shale indicator. A coal streak might be clearly resolved by a neutron log but missed entirely by a sonic log. Weighting factors are applied so that a given lithology is resolved by the log or group of logs that can resolve it most accurately. In addition, the lithology model allows the maximum concentration of any lithologic component to vary from zero to one-hundred percent (0–100%), thereby allowing calibration of the model to a core analysis. The lithology model also allows for limited ranges of existence for each lithologic component, further which can be based upon a core analysis. The lithology model may also include any other suitable model for predicting lithology and porosity.

The rock strength model 148 preferably includes a rock strength model as described in U.S. Pat. No. 5,767,399, issued Jun. 16, 1998, entitled "METHOD OF ASSAYING COMPRESSIVE STRENGTH OF ROCK," and incorporated herein by reference. The rock strength model provides a method for determining a confinement stress and rock strength in a given formation. The rock strength model may also include any other suitable model for predicting confinement stress and rock strength.

The shale plasticity model 150 preferably includes a shale plasticity model as described in U.S. Pat. No. 6,052,649, issued Apr. 18, 2000, entitled "METHOD AND APPARATUS FOR QUANTIFYING SHALE PLASTICITY FROM WELL LOGS," and incorporated herein by reference. The shale plasticity model provides a method for quantifying shale plasticity of a given formation. The shale plasticity model may also include any other suitable model for predicting shale plasticity. The geology models thus provide for generating a model of the particular geologic application of a given formation.

The drilling mechanics models 144 include a mechanical efficiency model 152, a hole cleaning efficiency model 154, a bit wear model 156, and a penetration rate model 158. The mechanical efficiency model 152 preferably includes a mechanical efficiency model as described in U.S. Pat. No 6,131,673, issued Oct. 17, 2000, entitled "METHOD OF ASSAYING DOWNHOLE OCCURRENCES AND CONDITIONS" (Attorney docket BT-1307 CIP1/5528.322) and incorporated herein by reference. The mechanical efficiency model provides a method for determining the bit mechanical efficiency. In the mechanical efficiency model, mechanical efficiency is defined as the percentage of the torque that cuts. The remaining torque is dissipated as friction. The mechanical efficiency model a) reflects the 3-D bit geometry, b) is linked to cutting torque, c) takes into account the effect of operating constraints, and d) makes use of a torque and drag analysis.

With respect to the hole cleaning efficiency (HCE) model 154, the model takes into account drilling fluid type, hydraulics, lithology, and shale plasticity. The hole cleaning efficiency model is a measure of an effectiveness of the drilling fluid and hydraulics. If the hole cleaning efficiency is low, then unremoved or slowly removed cuttings may have an adverse impact upon drilling mechanics.

The bit wear model 156 preferably includes a bit wear model as described in U.S. Pat. No. 5,794,720, issued Aug. 18, 1998, entitled "METHOD OF ASSAYING DOWNHOLE OCCURRENCES AND CONDITIONS," and incorporated herein by reference. The bit wear model provides a method for determining bit wear, i.e., to predict bit life and formation abrasivity. Furthermore, the bit wear model is used for applying a work rating to a given bit.

The penetration rate model 158 preferably includes a penetration rate model as described in U.S. Pat. No. 5,704,436, issued Jan. 16, 1998, entitled "METHOD OF REGULATING DRILLING CONDITIONS APPLIED TO A WELL BIT," and incorporated herein by reference. The penetration rate model provides a method for optimizing operating parameters and predicting penetration rate of the bit and drilling system. The ROP model provides for one or more of the following including: maximizing a penetration rate, establishing a power limit to avoid impact damage to the bit, respecting all operating constraints, optimizing operating parameters, and minimizing bit induced vibrations.

The drilling mechanics models 144 as described herein provide for generating a comprehensive model of the particular drilling system being used or proposed for use in the drilling of a well bore, interval(s) of a well bore, or series of well bores in a given drilling operation. The drilling mechanics models 144 further allow for the generation of a drilling mechanics performance prediction of the drilling system in a given geology. A comparison of actual performance to predicted performance can be used for history matching the drilling mechanics models, as may be required, for optimizing the respective drilling mechanics models.

With reference still to FIG. 3, the present method and apparatus include several modes of operation. The modes of operation include an optimization mode, a prediction mode, and a calibration mode. For the various modes of operation, predicted economics can be included for providing a measure of the number of fewer days per well which can be achieved when a drilling system is optimized using the method and apparatus of the present disclosure.

Optimization Mode

In the optimization mode, the purpose is to optimize operating parameters of the drilling system. Optimization criteria include 1) maximize penetration rate; 2) avoid impact damage to the bit; 3) respect all operating constraints; and 4) minimize bit-induced vibrations.

In the optimization mode, the lithology model 146 receives data from porosity logs, lithology logs and/or mud logs on input 160. The porosity or lithology logs may include nuclear magnetic resonance (NMR), photoelectric, neutron-density, sonic, gamma ray, and spectral gamma ray, or any other log sensitive to porosity or lithology. The mud logs are used to identify non-shale lithology components. In response to the log inputs, the lithology model 146 provides a measure of lithology and porosity of the given formation per unit depth on output 162. With respect to lithology, the output 162 preferably includes a volume fraction of each lithologic component of the formation per unit depth. With respect to porosity, the output 162 preferably includes a volume fraction of pore space within the rock of the formation per unit depth. The measure of lithology and porosity on output 162 is input to the rock strength model 148, shale plasticity model 150, mechanical efficiency model 152, hole cleaning efficiency model 154, bit wear model 162, and penetration rate model 158.

With respect to the rock strength model 148, in addition to receiving the measure of lithology and porosity output 162, rock strength model 148 further receives mud weight and pore pressure data at input 164. Mud weight is used to calculate overbalance. Pore pressure is used to calculate overbalance and alternatively, design overbalance may be used to estimate pore pressure. In response to the inputs, the rock strength model 148 produces a measure of confinement stress and rock strength of the given formation per unit depth on output 166. More particularly, the rock strength model produces a measure of overbalance, effective pore pressure, confinement stress, unconfined rock strength, and confined rock strength. Overbalance is defined as mud weight minus pore pressure. Effective pore pressure is similar to pore pressure, but also reflects permeability reduction in shales and low porosity non-shales. Confinement stress is an estimate of in-situ confinement stress of rock. Unconfined rock strength is rock strength at the surface of the earth. Lastly, confined rock strength is rock strength under in-situ confinement stress conditions. As shown, the rock strength output 166 is input to the mechanical efficiency model 152, bit wear model 162, and penetration rate model 158.

With respect to the mechanical efficiency model 152, in addition to receiving the lithology and porosity output 162 and confinement stress and rock strength output 166, mechanical efficiency model 152 further receives input data relating to operating constraints, 3-D bit model, and torque and drag, all relative to the drilling system, on input 168. Operating constraints can include a maximum torque, maximum weight-on-bit (WOB), maximum and minimum RPM, and maximum penetration rate. In particular, with respect to mechanical efficiency, operating constraints on the drilling system include maximum torque, maximum weight-on-bit (WOB), minimum RPM, and maximum penetration rate. Operating constraints limit an amount of optimization that can be achieved with a particular drilling system. Further with respect to evaluating the effect of operating constraints on mechanical efficiency, while not all constraints affect both mechanical efficiency and power, it is necessary to know all of the constraints in order to quantify the effects of those constraints which have an effect upon either mechanical efficiency or power. The 3-D bit model input includes a bit work rating and a torque-WOB signature. Lastly, the torque and drag analysis includes a directional proposal, casing and drill string geometry, mud weight and flow rate, friction factors, or torque and drag measurements. The torque and drag analysis is needed to determine how much surface torque is actually transmitted to the bit. Alternatively, measurements of off-bottom and on-bottom torque could be used in lieu of the torque and drag analysis.

In addition, near bit measurements from an measurement while drilling (MWD) system could also be used in lieu of the torque and drag analysis. In response to the input information, the mechanical efficiency model 152 produces a measure of mechanical efficiency, constraint analysis, predicted torque, and optimum weight-on-bit (WOB) for the drilling system in the given formation per unit depth on output 170. More particularly, the mechanical efficiency model 152 provides a measure of total torque, cutting torque, frictional torque, mechanical efficiency, a constraint analysis, and an optimum WOB. The total torque represents a total torque applied to the bit. The cutting torque represents the cutting component of the total torque. The frictional torque is the frictional component of the total torque. With mechanical efficiency model 152, the mechanical efficiency is defined as the percentage of the total torque that cuts. The constraint analysis quantifies the reduction in mechanical efficiency from a theoretical maximum value due to each operating constraint. Lastly, an optimum WOB is determined for which the WOB maximizes the penetration rate while respecting all operating constraints. The optimum WOB is used by the penetration rate model 158 to calculate an optimum RPM. Furthermore, mechanical efficiency model 152 utilizes a measure of bit wear from a previous iteration as input also, to be described further below with respect to the bit wear model.

With respect now to bit wear model 156, the bit wear model receives input from the lithology model via output 162, the rock strength model via output 166, and the mechanical efficiency model via output 170. In addition, the bit wear model 156 further receives 3-D bit model data on input 172. The 3-D bit model input includes a bit work rating and a torque-WOB signature. In response to the inputs of lithology, porosity, mechanical efficiency, rock strength, and the 3-D bit model, the bit wear model 156 produces a measure of specific energy, cumulative work, formation abrasivity, and bit wear with respect to the bit in the given formation per unit depth on output 174. The specific energy is the total energy applied at the bit, which is equivalent to the bit force divided by the bit cross-sectional area. The cumulative work done by the bit reflects both the rock strength and the mechanical efficiency. The formation abrasivity measure models an accelerated wear due to formation abrasivity. Lastly, the measure of bit wear corresponds to a wear condition that is linked to bit axial contact area and mechanical efficiency. In addition to output 174, bit wear model 156 further includes providing a measure of bit wear from a previous iteration to the mechanical efficiency model 152 on output 176, wherein the mechanical efficiency model 152 further utilizes the bit wear measure from a previous iteration in the calculation of its mechanical efficiency output data on output 170.

Prior to discussing the penetration rate model 158, we first return to the shale plasticity model 150. As shown in FIG. 3, the shale plasticity model 150 receives input from the lithology model. In particular, shale volume is provided from the lithology model 146. In addition to receiving the lithology and porosity output 162, the shale plasticity model 150 further receives log data from prescribed well logs on input 178, the well logs including any log sensitive to clay type, clay water content, and clay volume. Such logs may include nuclear magnetic resonance (NMR), neutron-density, sonic-density, spectral gamma ray, gamma ray, and cation exchange capacity (CEC). In response to the inputs, the shale plasticity model 150 produces a measure of shale plasticity of the formation per unit depth on output 180. In particular, shale plasticity model 150 provides a measure of normalized clay type, normalized clay water content, normalized clay volume, and shale plasticity. The normalized clay type identifies a maximum concentration of smectites, wherein smectite is the clay type most likely to cause clay swelling. The normalized clay water content identifies the water content where a maximum shale plasticity occurs. The normalized clay volume identifies the range of clay volume where plastic behavior can occur. Lastly, shale plasticity is a weighted average of the normalized clay properties and reflects an overall plasticity.

With reference to the hole cleaning efficiency model 154, model 154 receives a shale plasticity input from the shale plasticity model 150 and a lithology input from the lithology model 146. In addition to receiving the lithology model output 162 and the shale plasticity model output 180, the hole cleaning efficiency model 154 further receives hydraulics and drilling fluid data on input 182. In particular, the hydraulics input can include any standard measure of hydraulic efficiency, such as, hydraulic horsepower per square inch of bit diameter. In addition, the drilling fluid type may include water base mud, oil base mud, polymer, or other known fluid type. In response to the inputs, the hole cleaning efficiency model 154 produces a measure of a predicted hole cleaning efficiency of the bit and drilling system in the drilling of a well bore (or interval) in the formation per unit depth on output 184. Hole cleaning efficiency is defined herein as the actual over the predicted penetration rate. While the other drilling mechanics models assume perfect hole cleaning, the hole cleaning efficiency (HCE) model is a measure of correction to the penetration rate prediction to compensate for hole cleaning that deviates from ideal behavior. Thus, the measure of hole cleaning efficiency (HCE) reflects the effects of lithology, shale plasticity, hydraulics, and drilling fluid type on penetration rate.

With reference now to the penetration rate model 158, the penetration rate model 158 receives mechanical efficiency, predicted torque, and optimum WOB via output 170 of the mechanical efficiency model 152. Model 158 further receives bit wear via output 174 of the bit wear model 156, rock strength via output 166 of rock strength model 148, and predicted HCE via output 184 of HCE model 154. In addition, the penetration rate model 158 further receives operating constraints information on input 186. In particular, the operating constraints include a maximum torque, maximum weight-on-bit (WOB), maximum and minimum RPM, and maximum penetration rate. Further with respect to evaluating the effect of operating constraints on power, while not all constraints affect both mechanical efficiency and power, it is necessary to know all of the constraints in order to quantify the effects of those constraints which have an effect upon either mechanical efficiency or power. In response to the inputs, the penetration rate model 158 produces a power level analysis, a constraint analysis, and in addition, a measure of optimum RPM, penetration rate, and economics of the bit and drilling system in the drilling of a well bore (or interval) in the formation per unit depth on output 188. More particularly, the power level analysis includes a determination of a maximum power limit. The maximum power limit maximizes penetration rate without causing impact damage to the bit. The operating power level may be less than the maximum power limit due to operating constraints. The constraint analysis includes quantifying the reduction in operating power level from the maximum power limit due to each operating constraint. The optimum RPM is that RPM which maximizes penetration rate while respecting all operating constraints. The penetration rate is the predicted penetration rate at the optimum WOB and optimum RPM. Lastly, economics can include the industry standard cost per foot analysis.

Prediction Mode

In the prediction mode, the object or purpose is to predict drilling performance with user-specified operating parameters that are not necessarily optimal. Operating constraints do not apply in this mode. The prediction mode is essentially similar to the optimization mode, however with exceptions with respect to the mechanical efficiency model 152, bit wear model 156, and the penetration rate model 158, further as explained herein below. The hole cleaning efficiency model 154 is the same for both the optimization and prediction modes, since the hole cleaning efficiency is independent of the mechanical operating parameters (i.e., user-specified WOB and user-specified RPM).

With respect to the mechanical efficiency model 152, in the prediction mode, in addition to receiving the lithology and porosity output 162 and confinement stress and rock strength output 166, mechanical efficiency model 152 further receives input data relating to user-specified operating parameters and a 3-D bit model, relative to the drilling system, on input 168. The user-specified operating parameters for the drilling system can include a user-specified weight-on-bit (WOB) and a user-specified RPM. This option is used for evaluating "what if" scenarios. The 3-D bit model input includes a bit work rating and a torque-WOB signature. In response to the input, the mechanical efficiency model 152 produces a measure of mechanical efficiency for the drilling system in the given formation per unit depth on output 170. More particularly, the mechanical efficiency model 152 provides a measure of total torque, cutting torque, frictional torque, and mechanical efficiency. The total torque represents the total torque applied to the bit. In the prediction mode, the total torque corresponds to the user-specified weight-on-bit. The cutting torque represents the cutting component of the total torque on the bit. The frictional torque is the frictional component of the total torque on the bit.

With mechanical efficiency model 152, the mechanical efficiency is defined as the percentage of the total torque that cuts. The prediction mode may also include an analysis of mechanical efficiency by region, that is, by region of mechanical efficiency with respect to a bit's mechanical efficiency torque-WOB signature. A first region of mechanical efficiency is defined by a first weight-on-bit (WOB) range from zero WOB to a threshold WOB, wherein the threshold WOB corresponds to a given WOB necessary to just penetrate the rock, further corresponding to a zero (or negligible) depth of cut. The first region of mechanical efficiency further corresponds to a drilling efficiency of efficient grinding. A second region of mechanical efficiency is defined by a second weight-on-bit range from the threshold WOB to an optimum WOB, wherein the optimum WOB corresponds to a given WOB necessary to just achieve a maximum depth of cut with the bit, prior to the bit body contacting the earth formation. The second region of mechanical efficiency further corresponds to a drilling efficiency of efficient cutting. A third region of mechanical efficiency is defined by a third weight-on-bit range from the optimum WOB to a grinding WOB, wherein the grinding WOB corresponds to a given WOB necessary to cause cutting torque of the bit to just be reduced to essentially zero or become negligible. The third region of mechanical efficiency further corresponds to a drilling efficiency of inefficient cutting. Lastly, a fourth region of mechanical efficiency is defined by a fourth weight-on-bit range from the grinding WOB and above. The fourth region of mechanical efficiency further corresponds to a drilling efficiency of inefficient grinding. With respect to regions three and four, while the bit is at a maximum depth of cut, as WOB is further increased, frictional contact of the bit body with the rock formation is also increased.

Furthermore, mechanical efficiency model 152 utilizes a measure of bit wear from a previous iteration as input also, to be described further below with respect to the bit wear model.

With respect now to bit wear model 156, in the prediction mode, the bit wear model receives input from the lithology model via output 162, the rock strength model via output 166, and the mechanical efficiency model via output 170. In addition, the bit wear model 156 further receives 3-D bit model data on input 172. The 3-D bit model input includes a bit work rating and a torque-WOB signature. In response to the inputs of lithology, porosity, mechanical efficiency, rock strength, and the 3-D bit model, the bit wear model 156 produces a measure of specific energy, cumulative work, formation abrasivity, and bit wear with respect to the bit in the given formation per unit depth on output 174. The specific energy is the total energy applied at the bit, which is equivalent to the bit force divided by the bit cross-sectional area. Furthermore, the calculation of specific energy is based on the user-specified operating parameters. The cumulative work done by the bit reflects both the rock strength and the mechanical efficiency. The calculation of cumulative work done by the bit is also based on the user-specified operating parameters. The formation abrasivity measure models an accelerated wear due to formation abrasivity. Lastly, the measure of bit wear corresponds to a wear condition that is linked to bit axial contact area and mechanical efficiency. As with the calculations of specific energy and cumulative work, the bit wear calculation is based on the user-specified operating parameters. In addition to output 174, bit wear model 156 further includes providing a measure of bit wear from a previous iteration to the mechanical efficiency model 152 on output 176, wherein the mechanical efficiency model 152 further utilizes the bit wear measure from a previous iteration in the calculation of its mechanical efficiency output data on output 170.

With reference now to the penetration rate model 158, the penetration rate model 158 receives mechanical efficiency and predicted torque via output 170 of the mechanical efficiency model 152. Model 158 further receives bit wear via output 174 of the bit wear model 156, rock strength via output 166 of rock strength model 148, and predicted HCE via output 184 of HCE model 154. In addition, the penetration rate model 158 further receives user-specified operating parameters on input 186. In particular, the user-specified operating parameters include a user-specified weight-on-bit (WOB) and a user-specified RPM. As mentioned above, this prediction mode of operation is used to evaluate "what if" scenarios. In response to the inputs, the penetration rate model 158 produces a power level analysis and, in addition, a measure of penetration rate and economics of the bit and drilling system in the predicted drilling of a well bore (or interval) in the formation per unit depth on output 188. More particularly, the power level analysis includes a determination of a maximum power limit. The maximum power limit corresponds to a prescribed power which, when applied to the bit, maximizes penetration rate without causing impact damage to the bit. The operating power level resulting from the user-specified operating parameters may be less than or greater than the maximum power limit. Any operating power levels which exceed the maximum power limit of the bit can be flagged automatically, for example, by suitable programming, for indicating or identifying those intervals of a well bore where impact damage to the bit is likely to occur. The power level analysis would apply to the particular drilling system and its use in the drilling of a well bore (or interval) in the given formation. In addition, the penetration rate is the predicted penetration rate at user-specified WOB and user-specified RPM. Lastly, economics includes the industry standard cost per foot analysis.

Calibration Mode

Lastly, in the calibration mode, the object or purpose is to calibrate the drilling mechanics models to measured operating parameters. In addition, the geology models may be calibrated to measured core data. Furthermore, it is possible to partially or fully calibrate any model or group of models. Similarly as with the prediction mode, operating constraints do not apply in the calibration mode.

Beginning first with the geology models 142, measured core data may be used to calibrate each geology model. With respect to the lithology model, the lithology model 146 receives data from porosity logs, lithology logs and/or mud logs, and core data on input 160. As mentioned above, the porosity or lithology logs may include nuclear magnetic resonance (NMR), photoelectric, neutron-density, sonic, gamma ray, and spectral gamma ray, or any other log sensitive to porosity or lithology. The mud logs are used to identify non-shale lithology components. Core data includes measured core data which may be used to calibrate the lithology model. Calibration of the lithology model with measured core data allows the predicted lithologic composition to be in better agreement with measured core composition. Measured core porosity may also be used to calibrate any log-derived porosity. In response to the inputs, the lithology model 146 provides a measure of lithology and porosity of the given formation per unit depth on output 162. With respect to calibrated lithology, the output 162 preferably includes a volume fraction of each desired lithologic component of the formation per unit depth calibrated to a core analysis and/or a mud log. With respect to calibrated porosity, the log-derived output 162 preferably is calibrated to measured core porosity. Also, less accurate logs may be calibrated to more accurate logs. The calibration of lithology and porosity on output 162 is input to the rock strength model 148, shale plasticity model 150, mechanical efficiency model 152, hole cleaning efficiency model 154, bit wear model 162, and penetration rate model 158.

With respect to the rock strength model 148, inputs and outputs are similar to that as discussed herein above with respect to the optimization mode. However in the calibration mode, the input 164 further includes core data. Core data includes measured core data which may be used to calibrate the rock strength model. Calibration allows the predicted rock strength to be in better agreement with measured core strength. In addition, measured pore pressure data may also be used to calibrate the confinement stress calculation.

With respect to the shale plasticity model 150, inputs and outputs are similar to that as discussed herein above with respect to the optimization mode. However in the calibration mode, the input 178 further includes core data. Core data includes measured core data which may be used to calibrate the shale plasticity model. Calibration allows the predicted plasticity to be in better agreement with measured core plasticity. In response to the inputs, the shale plasticity model 150 provides a measure of shale plasticity of the given formation per unit depth on output 180. With respect to calibrated shale plasticity, the output 180 preferably includes a weighted average of the normalized clay properties that reflects the overall plasticity calibrated to a core analysis.

With respect to the mechanical efficiency model 152, inputs and outputs are similar to that as discussed herein above with respect to the optimization mode, with the following exceptions. In the calibration mode, input 168 does not include operating constraints or torque and drag analysis, however, in the calibration mode, the input 168 does include measured operating parameters. Measured operating parameters include weight-on-bit (WOB), RPM, penetration rate, and torque (optional), which may be used to calibrate the mechanical efficiency model. In response to the inputs, the mechanical efficiency model 152 provides a measure of total torque, cutting torque, frictional torque, and calibrated mechanical efficiency on output 170. With respect to total torque, total torque refers to the total torque applied to the bit, further which is calibrated to measured torque if data is available. Cutting torque refers to the cutting component of total torque on bit, further which is calibrated to an actual mechanical efficiency. Frictional torque refers to the frictional component of the total torque on bit, further which is calibrated to the actual mechanical efficiency. With respect to calibrated mechanical efficiency, mechanical efficiency is defined as the percentage of the total torque that cuts. The predicted mechanical efficiency is calibrated to the actual mechanical efficiency. The calibration is more accurate if measured torque data is available. However, it is possible to partially calibrate the mechanical efficiency if torque data is unavailable, by using a predicted torque along with the other measured operating parameters.

In the calibration mode, an analysis of mechanical efficiency by region, that is, by region of mechanical efficiency with respect to a bit's mechanical efficiency torque-WOB signature, may also be included. As indicated above, the first region of mechanical efficiency is defined by a first weight-on-bit (WOB) range from zero WOB to a threshold WOB, wherein the threshold WOB corresponds to a given WOB necessary to just penetrate the rock, further corresponding to a zero (or negligible) depth of cut. The first region of mechanical efficiency further corresponds to a drilling efficiency of efficient grinding. The second region of mechanical efficiency is defined by a second weight-on-bit range from the threshold WOB to an optimum WOB, wherein the optimum WOB corresponds to a given WOB necessary to just achieve a maximum depth of cut with the bit, prior to the bit body contacting the earth formation. The second region of mechanical efficiency further corresponds to a drilling efficiency of efficient cutting. The third region of mechanical efficiency is defined by a third weight-on-bit range from the optimum WOB to a grinding WOB, wherein the grinding WOB corresponds to a given WOB necessary to cause cutting torque of the bit to just be reduced to essentially zero or become negligible. The third region of mechanical efficiency further corresponds to a drilling efficiency of inefficient cutting. Lastly, the fourth region of mechanical efficiency is defined by a fourth weight-on-bit range from the grinding WOB and above. The fourth region of mechanical efficiency further corresponds to a drilling efficiency of inefficient grinding. With respect to regions three and four, while the bit is at a maximum depth of cut, as WOB is further increased, frictional contact of the bit body with the rock formation is also increased.

With respect to the bit wear model 156, inputs and outputs are similar to that as discussed herein above with respect to the optimization mode. However in the calibration mode, the input 172 further includes bit wear measurement. Bit wear measurement includes a measure of a current axial contact area of the bit. Furthermore, the bit wear measurement is correlated with the cumulative work done by the bit based on the measured operating parameters. In response to the inputs, the bit wear model 156 provides a measure of specific energy, cumulative work, calibrated formation abrasivity, and calibrated bit work rating with respect to the given drilling system and formation per unit depth on output 174. With respect to specific energy, specific energy corresponds to the total energy applied at the bit. In addition, specific energy is equivalent to the bit force divided by the bit cross-sectional area, wherein the calculation is further based on the measured operating parameters. With respect to cumulative work, the cumulative work done by the bit reflects both the rock strength and mechanical efficiency. In addition, the calculation of cumulative work is based on the measured operating parameters. With respect to calculated formation abrasivity, the bit wear model accelerates wear due to formation abrasivity. Furthermore, the bit wear measurement and cumulative work done can be used to calibrate the formation abrasivity. Lastly, with respect to calibrated bit work rating, the dull bit wear condition is linked to cumulative work done. In calibration mode, the bit work rating of a given bit can be calibrated to the bit wear measurement and cumulative work done.

With respect to the hole cleaning efficiency model 154, inputs and outputs are similar to that as discussed herein above with respect to the optimization mode. However, in the calibration mode, the hole cleaning efficiency is calibrated by correlating to the measured HCE in the penetration rate model, further as discussed herein below.

With respect to the penetration rate model 158, inputs and outputs are similar to that as discussed herein above with respect to the optimization mode. However, in the calibration mode, input 186 does not include operating constraints, but rather, the input 168 does include measured operating parameters and bit wear measurement. Measured operating parameters include weight-on-bit (WOB), RPM, penetration rate, and torque (optional). Bit wear measurement is a measure of current axial contact area of the bit and also identifies the predominant type of wear including uniform and non-uniform wear. For example, impact damage is a form of non-uniform wear. Measured operating parameters and bit wear measurements may be used to calibrate the penetration rate model. In response to the inputs, the penetration rate model 158 provides a measure of calibrated penetration rate, calibrated HCE, and calibrated power limit. With respect to calibrated penetration rate, calibrated penetration rate is a predicted penetration rate at the measured operating parameters. The predicted penetration rate is calibrated to the measured penetration rate using HCE as the correction factor. With respect to calibrated HCE, HCE is defined as the actual over the predicted penetration rate. The predicted HCE from the HCE model is calibrated to the HCE calculated in the penetration rate model. Lastly, with respect to the calibrated power limit, the maximum power limit maximizes penetration rate without causing impact damage to the bit. If the operating power level resulting from the measured operating parameters exceeds the power limit then impact damage is likely. The software or computer program for implementing the predicting of the performance of a drilling system can be set up to automatically flag any operating power level which exceeds the power limit. Still further, the power limit may be adjusted to reflect the type of wear actually seen on the dull bit. For example, if the program flags intervals where impact damage is likely, but the wear seen on the dull bit is predominantly uniform, then the power limit is probably too conservative and should be raised.

A performance analysis may also be performed which includes an analysis of the operating parameters. Operating parameters to be measured include WOB, TOB (optional), RPM, and ROP. Near bit measurements are preferred for more accurate performance analysis results. Other performance analysis measurements include bit wear measurements, drilling fluid type and hydraulics, and economics.

Overview

With reference again to FIG. 1, apparatus 50 for predicting the performance of a drilling system 10 for the drilling of a well bore 14 in a given formation 24 will now be further discussed. The prediction apparatus 50 includes a computer/controller 52 for generating a geology characteristic of the formation per unit depth according to a prescribed geology model and for outputting signals representative of the geology characteristic. Preferably, the geology characteristic includes at least rock strength. In addition, the geology characteristic generating means 52 may further generate at least one of the following additional characteristics selected from the group consisting of log data, lithology, porosity, and shale plasticity.

Input device(s) 58 is (are) provided for inputting specifications of proposed drilling equipment for use in the drilling of the well bore, wherein the specifications include at least a bit specification of a recommended drill bit. In addition, input device(s) 58 may further be used for inputting additional proposed drilling equipment input specification(s) which may also include at least one additional specification of proposed drilling equipment selected from the group consisting of down hole motor, top drive motor, rotary table motor, mud system, and mud pump.

Lastly, computer/controller 52 is further for determining a predicted drilling mechanics in response to the specifications of the proposed drilling equipment as a function of the geology characteristic per unit depth according to a prescribed drilling mechanics model. Computer/controller 52 is further for outputting signals representative of the predicted drilling mechanics, the predicted drilling mechanics including at least one of the following selected from the group consisting of bit wear, mechanical efficiency, power, and operating parameters. The operating parameters may include at least one of the following selected from the group consisting of weight-on-bit, rotary rpm (revolutions-per-minute), cost, rate of penetration, and torque. Additionally, rate of penetration includes instantaneous rate of penetration (ROP) and average rate of penetration (ROP-AVG).

As illustrated in FIG. 1, display 60 and printer 62 each provide a means responsive to the geology characteristic output signals and the predicted drilling mechanics output signals for generating a display of the geology characteristic and predicted drilling mechanics per unit depth. With respect to printer 62, the display of the geology characteristic and predicted drilling mechanics per unit depth includes a printout 64. In addition, computer/controller 52 may further provide drilling operation control signals on line 66, relating to given predicted drilling mechanics output signals. In such an instance, the drilling system could further include one or more devices which are responsive to a drilling operation control signal based upon a predicted drilling mechanics output signal for controlling a parameter in an actual drilling of the well bore with the drilling system. Exemplary parameters may include at least one selected from the group consisting of weight-on-bit, rpm, pump flow, and hydraulics.

Display of Predicted Performance

Figure 4A:
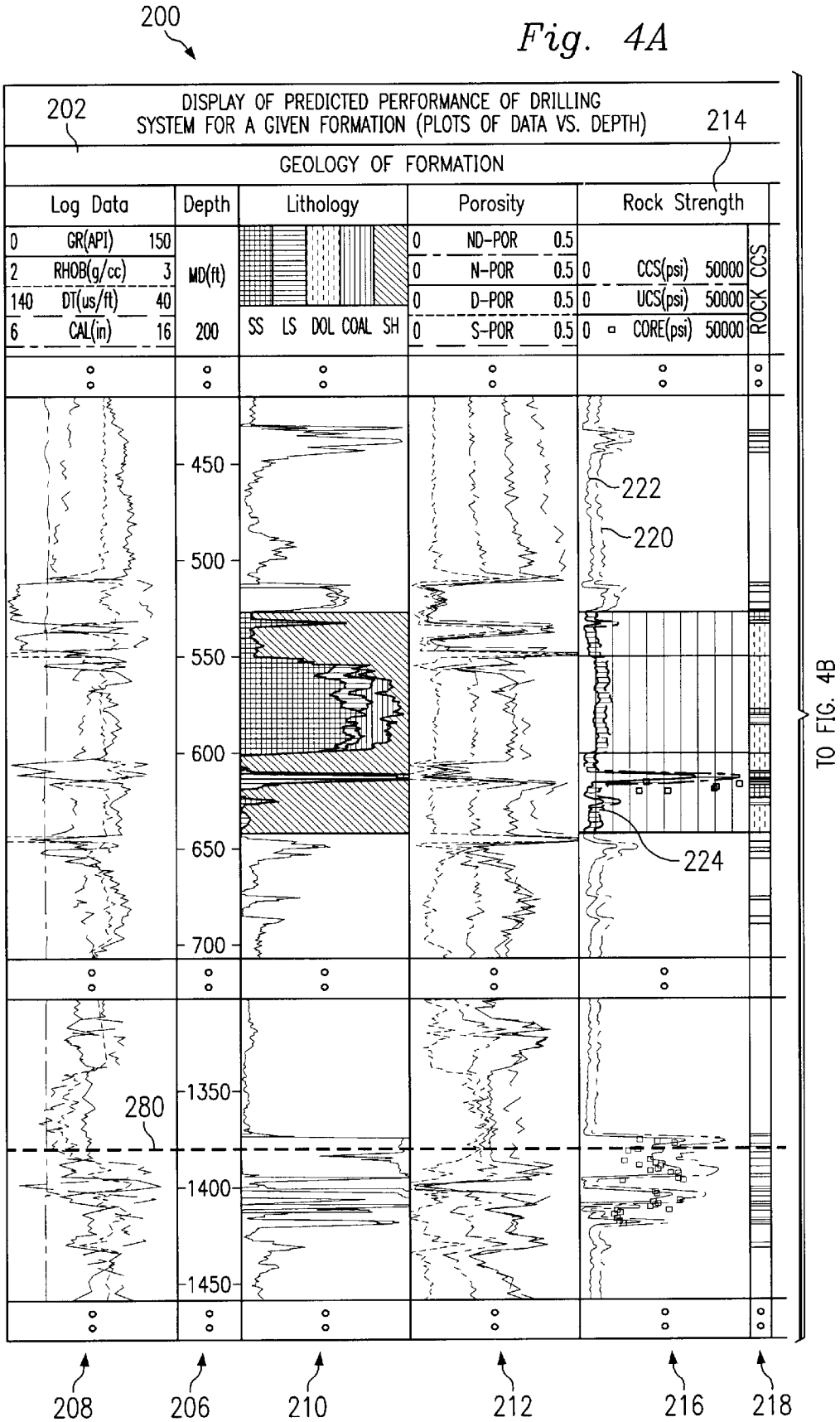
FIG. 4 (4*a*, 4*b*, and 4*c*) illustrates one embodiment of a display of predicted performance of a drilling system for a given formation according to the method and apparatus of the present disclosure.
Figure 4B:
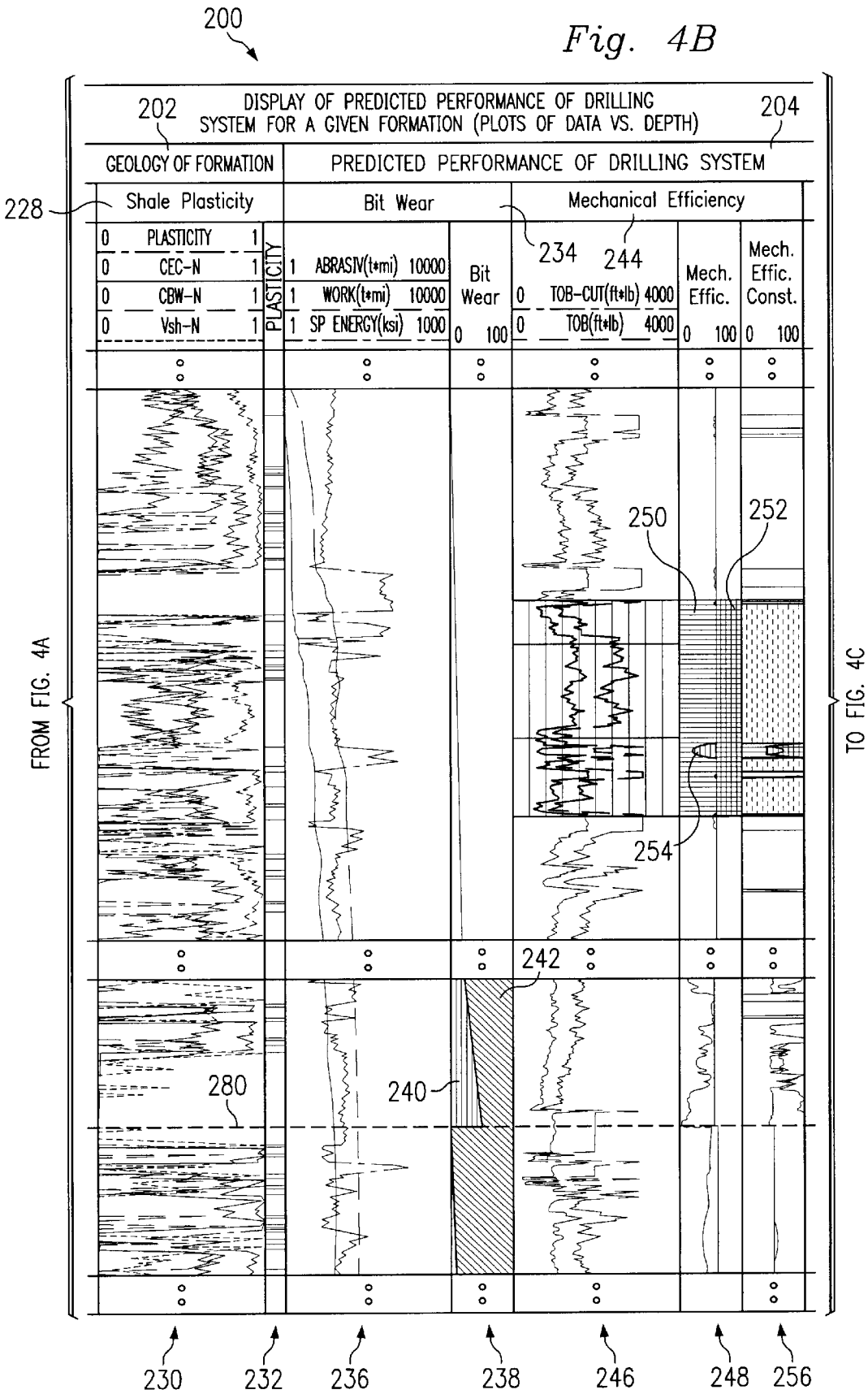

With reference now to FIG. 4, a display 200 of predicted performance of the drilling system 50 (FIG. 1) for a given formation 24 (FIG. 1) shall now be described in further detail. Display 200 includes a display of geology characteristic 202 and a display of predicted drilling mechanics 204. The display of the geology characteristic 202 includes at least one graphical representation selected from the group consisting of a curve representation, a percentage graph representation, and a band representation. In addition, the display of the predicted drilling mechanics 204 includes at least one graphical representation selected from the group consisting of a curve representation, a percentage graph representation, and a band representation. In a preferred embodiment, the at least one graphical representation of the geology characteristic 202 and the at least one graphical representation of the predicted drilling mechanics 204 are color coded.

Header Description

The following is a listing of the various symbols, corresponding brief descriptions, units, and data ranges with respect to the various columns of information illustrated in FIG. 4. Note that this listing is exemplary only, and not intended to be limiting. It is included herein for providing a thorough understanding of the illustration of FIG. 4. Other symbols, descriptions, units, and data ranges are possible.

| Header Symbol | Description | Units | Data Range |
|---|---|---|---|
| Log Data Column (208): | | | |
| GR (API) | Gamma Ray Log | API | 0–150 |
| RHOB (g/cc) | Bulk Density Log | g/cc | 2–3 |
| DT (μs/ft) | Acoustic or Sonic Log | microsec/ft | 40–140 |
| CAL (in) | Caliper Log | in | 6–16 |
| Depth Column (206): | | | |
| MD (ft) | Measured Depth | ft (or meters) | 200–1700 |
| Lithology Column (210): | | | |
| SS | Sandstone concentration | % | 0–100 |
| LS | Limestone concentration | % | 0–100 |
| DOL | Dolomite concentration | % | 0–100 |
| COAL | Coal concentration | % | 0–100 |
| SH | Shale concentration | % | 0–100 |
| Porosity Column (212): | | | |
| ND-POR | Neutron-Density Porosity | % (fractional) | 0–1 |
| N-POR | Neutron Porosity | % (fractional) | 0–1 |
| D-POR | Density Porosity | % (fractional) | 0–1 |
| S-POR | Sonic Porosity | % (fractional) | 0–1 |
| Rock Strength Column (216): | | | |
| CRS (psi) | Confined Rock Strength | psi | 0–50,000 |
| URS (psi) | Unconfined Rock Strength | psi | 0–50,000 |
| CORE (psi) | Measured Core Strength | psi | 0–50,000 |
| Rock Strength Column (218): | | | |
| ROCK CRS | Confined Rock Strength | psi | 0–50,000 |
| Shale Plasticity Column (230): | | | |
| PLASTICITY | Shale Plasticity | % (fractional) | 0–1 |
| CEC-N | Normalized Cation Exchange Capacity | % (fractional) | 0–1 |

-continued

| Header Symbol | Description | Units | Data Range |
|---|---|---|---|
| CBW-N | Normalized Clay Bound Water | % (fractional) | 0–1 |
| Vsh-N | Normalized Shale Volume | % (fractional) | 0–1 |
| Shale Plasticity Column (232): | | | |
| PLASTICITY | Shale Plasticity | % | 0–100 |
| Bit Wear Column (236): | | | |
| ABRASIV (t·mi) | Formation Abrasivity | ton·miles | 0–10,000 |
| WORK (t·mi) | Cumulative Work | ton·miles | 0–10,000 |
| SP ENERGY (ksi) | Specific Energy | ksi (1,000 psi) | 0–1,000 |
| Bit Wear Column (238): | | | |
| Red[1] | Expended Bit Life | % | 0–100 |
| Green[1] | Remaining Bit Life | % | 0–100 |
| Mechanical Efficiency Column (246): | | | |
| TOB-CUT (ft·lb) | Cutting torque on bit | ft·lb | 0–4,000 |
| TOB (ft·lb) | Total torque on bit | ft·lb | 0–4,000 |
| Mechanical Efficiency Column (248): | | | |
| Cyan[1] | Cutting Torque | % | 0–100 |
| Yellow[1] | Frictional Torque - Unconstrained | % | 0–100 |
| Red[1] | Frictional Torque - Constrained | % | 0–100 |
| Mechanical Efficiency Constraints Column (256): | | | |
| Cyan[1] | Maximum TOB Constraint | % | 0–100 |
| Red[1] | Maximum WOB Constraint | % | 0–100 |
| Yellow[1] | Minimum RPM Constraint | % | 0–100 |
| Green[1] | Maximum ROP Constraint | % | 0–100 |
| Blue[1] | Unconstrained | % | 0–100 |
| Power Column (260): | | | |
| POB-LIM (hp) | Power Limit | hp | 0–100 |
| POB (hp) | Operating Power Level | hp | 0–100 |
| Power Constraints Column (262): | | | |
| Cyan[1] | Maximum RPM Constraint | % | 0–100 |
| Red[1] | Maximum ROP Constraint | % | 0–100 |
| Blue[1] | Unconstrained | % | 0–100 |
| Operating Parameters Columns (266): | | | |
| RPM | Rotary RPM | rpm | 50–150 |
| WOB (lb) | Weight-on-bit | lb | 0–50,000 |
| COST ($/ft) | Drilling cost per foot | $/ft | 0–100 |
| ROP (ft/hr) | Instantaneous penetration rate | ft/hr | 0–200 |
| ROP-AVG (ft/hr) | Average penetration rate | ft/hr | 0–200 |

Note[1]: The color indicated is represented by a respective shading, further as illustrated on FIG. 4 for the respective column.

Depth, Log Data, Lithology, Porosity

As shown in FIG. 4, the depth of formation 206 is expressed in the form of a numeric representation. Log data 208 is expressed in the form of a curve representation, the log data 208 including any log suite sensitive to lithology and porosity. Lithology 210 is expressed in the form of a percentage graph for use in identifying different types of rock within the given formation, the percentage graph illustrating a percentage of each type of rock at a given depth as determined from any log suite sensitive to lithology. In one embodiment, the lithology percentage graph is color coded. Porosity 212 is expressed in the form of a curve representation, the porosity being determined from any log suite sensitive to porosity.

Rock Strength

On display 200 of FIG. 4, rock strength 214 is expressed in the form of at least one of the following representations selected from the group consisting of a curve representation 216, a percentage graph representation (not illustrated, but similar to 210), and a band representation 218. The curve representation 216 of rock strength includes confined rock strength 220 and unconfined rock strength 222. An area 224 between respective curves of confined rock strength 220 and unconfined rock strength 222 is graphically illustrated and represents an increase in rock strength as a result of a confining stress. The band representation 218 of rock strength provides a graphical illustration indicative of a discrete range of rock strength at a given depth, and more generally, to various discrete ranges of rock strength along the given well bore. In a preferred embodiment, the band representation 218 of the rock strength is color coded, including a first color representative of a soft rock strength range, a second color representative of a hard rock strength range, and additional colors representative of one or more intermediate rock strength ranges. Still further, the color blue can be used to be indicative of the soft rock strength range, red to be indicative of the hard rock strength range, and yellow to be indicative of an intermediate rock strength range. A legend 226 is provided on the display for assisting in an interpretation of the various displayed geology characteristics and predicted drilling mechanics.

Shale Plasticity

On display 200 of FIG. 4, shale plasticity 228 is expressed in the form of at least one of the following representations selected from the group consisting of a curve representation 230, a percentage graph representation (not illustrated, but similar to 210), and a band representation 232. The curve representation 230 of shale plasticity 228 includes at least two curves of shale plasticity parameters selected from the group consisting of water content, clay type, and clay volume, further wherein shale plasticity is determined from water content, clay type, and clay volume according to a prescribed shale plasticity model 150 (FIG. 3). In addition, the representations of shale plasticity are preferably color coded. The band representation 232 of the shale plasticity 228 provides a graphical illustration indicative of a discrete range of shale plasticity at a given depth, and more generally, to various discrete ranges of shale plasticity along the given well bore. In a preferred embodiment, the band representation 232 of the shale plasticity 228 is color coded, including a first color representative of a low shale plasticity range, a second color representative of a high shale plasticity range, and additional colors representative of one or more intermediate shale plasticity ranges. Still further, the color blue can be used to be indicative of the low shale plasticity range, red to be indicative of the high shale plasticity range, and yellow to be indicative of an intermediate shale plasticity range. As mentioned above, legend 226 on the display 200 provides for assisting in an interpretation of the various displayed geology characteristics and predicted drilling mechanics.

Bit Work/wear Relationship

Bit wear 234 is determined as a function of cumulative work done according to a prescribed bit wear model 156 (FIG. 3). On display 200 of FIG. 4, bit wear 234 is expressed in the form of at least one of the following representations selected from the group consisting of a curve representation 236 and a percentage graph representation 238. The curve representation 236 of bit wear may include bit work expressed as specific energy level at the bit, cumulative work done by the bit, and optional work losses due to abrasivity. With respect to the percentage graph representation, bit wear 234 can be expressed as a graphically illustrated percentage graph 238 indicative of a bit wear condition at a given depth. In a preferred embodiment, the graphically illustrated percentage graph 238 of bit wear is color coded, including a first color 240 representative of expired bit life, and a second color 242 representative of remaining bit life. Furthermore, the first color is preferably red and the second color is preferably green.

Mechanical Efficiency

Bit mechanical efficiency is determined as a function of a torque/weight-on-bit signature for the given bit according to a prescribed mechanical efficiency model 152 (FIG. 3). On display 200 of FIG. 4, bit mechanical efficiency 244 is expressed in the form of at least one of the following representations selected from the group consisting of a curve representation 246 and a percentage graph representation 248. The curve representation 246 of bit mechanical efficiency includes total torque (TOB(ft·lb)) and cutting torque (TOB-CUT(ft·lb)) at the bit. The percentage graph representation 248 of bit mechanical efficiency 244 graphically illustrates total torque, wherein total torque includes cutting torque and frictional torque components. In a preferred embodiment, the graphically illustrated percentage graph 248 of mechanical efficiency is color coded, including a first color for illustrating cutting torque 250, a second color for illustrating frictional unconstrained torque 252, and a third color for illustrating frictional constrained torque 254. Legend 226 also provides for assisting in an interpretation of the various torque components of mechanical efficiency. Still further, the first color is preferably blue, the second color is preferably yellow, and the third color is preferably red.

In addition to the curve representation 246 and the percentage graph 248, mechanical efficiency 244 is further represented in the form of a percentage graph 256 illustrating drilling system operating constraints which have an adverse impact upon mechanical efficiency. The drilling system operating constraints correspond to constraints which result in an occurrence of frictional constrained torque (for instance, as illustrated by reference numeral 254 in percentage graph 248), the percentage graph 256 further for indicating a corresponding percentage of impact that each constraint has upon the frictional constrained torque component of the mechanical efficiency at a given depth. The drilling system operating constraints can include maximum torque-on-bit (TOB), maximum weight-on-bit (WOB), minimum revolution-per-minute (RPM), maximum penetration rate (ROP), in any combination, and an unconstrained condition. In a preferred embodiment, the percentage graph representation 256 of drilling system operating constraints on mechanical efficiency is color coded, including different colors for identifying different constraints. Legend 226 further provides assistance in an interpretation of the various drilling system operating constraints on mechanical efficiency with respect to percentage graph representation 256.

Power

On display 200 of FIG. 4, power 258 is expressed in the form of at least one of the following representations selected from the group consisting of a curve representation 260 and a percentage graph representation 262. The curve representation 260 for power 258 includes power limit (POB-LIM (hp)) and operating power level (POB(hp)). The power limit (POB-LIM(hp)) corresponds to a maximum power to be applied to the bit. The operating power level (POB(hp)) includes at least one of the following selected from the group consisting of constrained operating power level, recommended operating power level, and predicted operating power level. With respect to the curve representation 260, a difference between the power limit (POB-LIM(hp)) and operating power level (POB(hp)) curves is indicative of a constraint.

Power 258 is further represented in the form of a percentage graph representation 262 illustrating drilling system operating constraints which have an adverse impact upon power. The drilling system operating constraints correspond to those constraints which result in a power loss. The power constraint percentage graph 262 is further for indicating a corresponding percentage of impact that each constraint has upon the power at a given depth. In a preferred embodiment, the percentage graph representation 262 of drilling system operating constraint on power is color coded, including different colors for identifying different constraints. Furthermore, red is preferably used to identify a maximum ROP, blue is preferably used to identify a maximum RPM, and dark blue is preferably used to identify an unconstrained condition. Legend 226 further provides assistance in an interpretation of the various drilling system operating constraints on power with respect to percentage graph representation 262.

Operating Parameters

As shown in FIG. 4, operating parameters 264 are expressed in the form of a curve representation 266. As discussed above, the operating parameters may include at least one of the following selected from the group consisting of weight-on-bit, rotary rpm (revolutions-per-minute), cost, rate of penetration, and torque. Additionally, rate of penetration includes instantaneous rate of penetration (ROP) and average rate of penetration (ROP-AVG).

Bit Selection/recommendation

Display 200 further provides a means for generating a display 268 of details of proposed or recommended drilling equipment. That is, details of the proposed or recommended drilling equipment are displayed along with the geology characteristic 202 and predicted drilling mechanics 204 on display 200. The proposed or recommended drilling equipment preferably include at least one bit selection used in predicting the performance of the drilling system. In addition, first and second bit selections, indicated by reference numerals 270 and 272, respectively, are recommended for use in a predicted performance of the drilling of the well bore. The first and second bit selections are identified with respective first and second identifiers, 276 and 278, respectively. The first and second identifiers, 276 and 278, respectively, are also displayed with the geology characteristic 202 and predicted drilling mechanics 204, further wherein the positioning of the first and second identifiers on the display 200 is selected to correspond with portions of the predicted performance to which the first and second bit selections apply, respectively. Still further, the display can include an illustration of each recommended bit selection and corresponding bit specifications.

Dashed Line

With reference still to FIG. 4, display 200 further includes a bit selection change indicator 280. Bit selection change indicator 280 is provided for indicating that a change in bit selection from a first recommended bit selection 270 to a second recommended bit selection 272 is required at a given depth. The bit selection change indicator 280 is preferably displayed on the display 200 along with the geology characteristics 202 and predicted drilling mechanics 204.

The method and apparatus of the present disclosure thus advantageously enables an optimization of a drilling system and its use in a drilling program to be obtained early in the drilling program. The present method and apparatus further facilitate the making of appropriate improvements early in the drilling program. Any economic benefits resulting from the improvements made early in the drilling program are advantageously multiplied by the number of wells remaining to be drilled in the drilling program. Significant and substantial savings for a company commissioning the drilling program can be advantageously achieved. Still further, the present method and apparatus provide for the making of measurements during drilling of each well bore, all the way through a drilling program, for the purpose of verifying that the particular drilling system equipment is being used optimally. Still further, drilling system equipment performance can be monitored more readily with the method and apparatus of the present disclosure, in addition to identifying potential adverse conditions prior to their actual occurrence.

Still further, with use of the present method and apparatus, the time required for obtaining of a successful drilling operation in which a given oil producing well of a plurality of wells is brought on-line is advantageously reduced. The method and apparatus of the present disclosure thus provide an increased efficiency of operation. Furthermore, the use of the present method and apparatus is particularly advantageous for a development project, for example, of establishing on the order of one hundred wells over a three year period in a given geographic location. With the present method and apparatus, a given well may be completed and be brought on-line, i.e., to marketable production, on the order of 30 days, for example, versus 60 days (or more) with the use of prior methods. With the improved efficiency of the drilling performance of a drilling system according to the present disclosure, a gain in time with respect to oil production is possible, which further translates into millions of dollars of oil product being available at an earlier date for marketing. Alternatively, for a given period of time, with the use of the present method and apparatus, one or more additional wells may be completed above and beyond the number of wells which would be completed using prior methods in the same period of time. In other words, drilling a new well in a lesser amount of time advantageously translates into marketable production at an earlier date.

The present embodiments advantageously provide for an evaluation of various proposed drilling equipment prior to and during an actual drilling of a well bore in a given formation, further for use with respect to a drilling program. Drilling equipment, its selection and use, can be optimized for a specific interval or intervals of a well bore (or interval) in a given formation. The drilling mechanics models advantageously take into account the effects of progressive bit wear through changing lithology. Recommended operating parameters reflect the wear condition of the bit in the specific lithology and also takes into account the operating constraints of the particular drilling rig being used. A printout or display of the geology characteristic and predicted drilling mechanics per unit depth for a given formation provides key information which is highly useful for a drilling operator, particularly for use in optimizing the drilling process of a drilling program. The printout or display further advantageously provides a heads up view of expected drilling conditions and recommended operating parameters.

The present embodiments provide a large volume of complex and critical information that is communicated clearly, for example, in a graphical format as illustrated and discussed herein with reference to FIG. 4. In addition, the use of color in the graphical format further accents key information. Still further, the display 200 advantageously provides a driller's road map. For example, with the display as a guide, the driller can be assisted with a decision of when to pull a given bit. The display further provides information regarding effects of operating constraints on performance and drilling mechanics. Still further, the display assists in selecting recommended operating parameters. With the use of the display, more efficient and safe drilling can be obtained. Most advantageously, important information is communicated clearly.

Real Time Aspects

According to another embodiment of the present disclosure, apparatus 50 (FIG. 1) is as discussed herein above, and further includes real-time aspects as discussed below. In particular, computer controller 52 is responsive to a predicted drilling mechanics output signal for controlling a control parameter in drilling of the well bore with the drilling system. The control parameter includes at one of the following parameters consisting of weight-on-bit, rpm, pump flow rate, and hydraulics. In addition, controller 52, logging instrumentation 16, measurement device processor 44, and other suitable devices are used to obtain at least one measurement parameter in real time during the drilling of the well bore, as discussed herein.

Computer controller 52 further includes a means for history matching the measurement parameter with a back calculated value of the measurement parameter. In particular, the back calculated value of the measurement parameter is a function of the drilling mechanics model and at least one control parameter. Responsive to a prescribed deviation between the measurement parameter and the back calculated value of the measurement parameter, controller 52 performs at least one of the following: a) adjusts the drilling mechanics model, b) modifies control of a control parameter, or c) performs an alarm operation.

According to another embodiment of the present disclosure, the method and apparatus for predicting the performance of a drilling system includes means for measuring a prescribed real-time drilling parameter during the drilling of a well bore in a given formation. Drilling parameters can be obtained during the drilling of the well bore using suitable commercially available measurement apparatus (such as MWD devices) for obtaining the given real-time parameter. The drilling system apparatus further operates in a prescribed real-time mode for comparing a given real-time drilling parameter with a corresponding predicted parameter. Accordingly, the present embodiment facilitates one or more operating modes, either alone or in combination, in a one-time, repetitive or cyclical manner. The operating modes can include, for example, a predictive mode, a calibration mode, an optimize mode, and a real-time control mode.

In yet another embodiment of the present disclosure, computer controller 52 is programmed for performing real-time functions as described herein, using programming techniques known in the art. A computer readable medium, such as a computer disk or other medium for communicating computer readable code (a global computer network, satellite communications, etc.) is included, the computer readable medium having a computer program stored thereon. The computer program for execution by computer controller 52 is similar to that disclosed earlier and having additional real-time capability features.

With respect to real-time capabilities, the computer program includes instructions for controlling a control parameter in drilling of the well bore with the drilling system in response to a predicted drilling mechanics output signal, the control parameter including at least one selected from the group consisting of weight-on-bit, rpm, pump flow rate, and hydraulics. The computer program also includes instructions for obtaining a measurement parameter in real time during the drilling of the well bore. Lastly, the computer program includes instructions for history matching the measurement parameter with a back calculated value of the measurement parameter, wherein the back calculated value of the measurement parameter is a function of at least one of the following selected from the group consisting of the drilling mechanics model and at least one control parameter. The instructions for controlling the control parameter further include instructions, responsive to a prescribed deviation between the measurement parameter and the back calculated value of the measurement parameter, for performing at least one of the following: a) adjusting the drilling mechanics model, b) modifying control of a control parameter, or c) performing an alarm operation.

In one embodiment of the drilling prediction analysis system, the system performs history matching by looking at the actual data accumulated during the drilling of a well bore and comparing the actual data to the predictions made during a corresponding planning phase. In response to an outcome of the history matching, some factors (e.g., underlying assumptions) in the drilling mechanics prediction model may need to be adjusted to obtain a better match of predicted performance with the actual performance. These adjustments might be due to various factors relating to the formation environment that are unique to the particular geographic area and how the environment interfaces with a particular bit design.

As mentioned, the real-time aspects of the present embodiments include the performing of comparisons of predicted performance to actual parameters while the well bore is being drilled. With the real-time aspects, the present embodiments overcome one disadvantage of an end-of job analysis, that is, with an end-of-job analysis, "lessons learned" can only be applied to subsequent wells. In contrast, with the real-time aspects of the present embodiments, any required adjustments to a drilling mechanics prediction model (applicable for the well being drilled) can be made, as well as making other suitable adjustments to better optimize the drilling process on that particular well. The real-time aspects further accelerate the learning curve with respect to the well (or wells) in a given field and a corresponding optimization process for each well. All of these benefits are independent of using the bit as a measurement tool, as discussed further herein below.

Real Time Optimization

Figure 5:
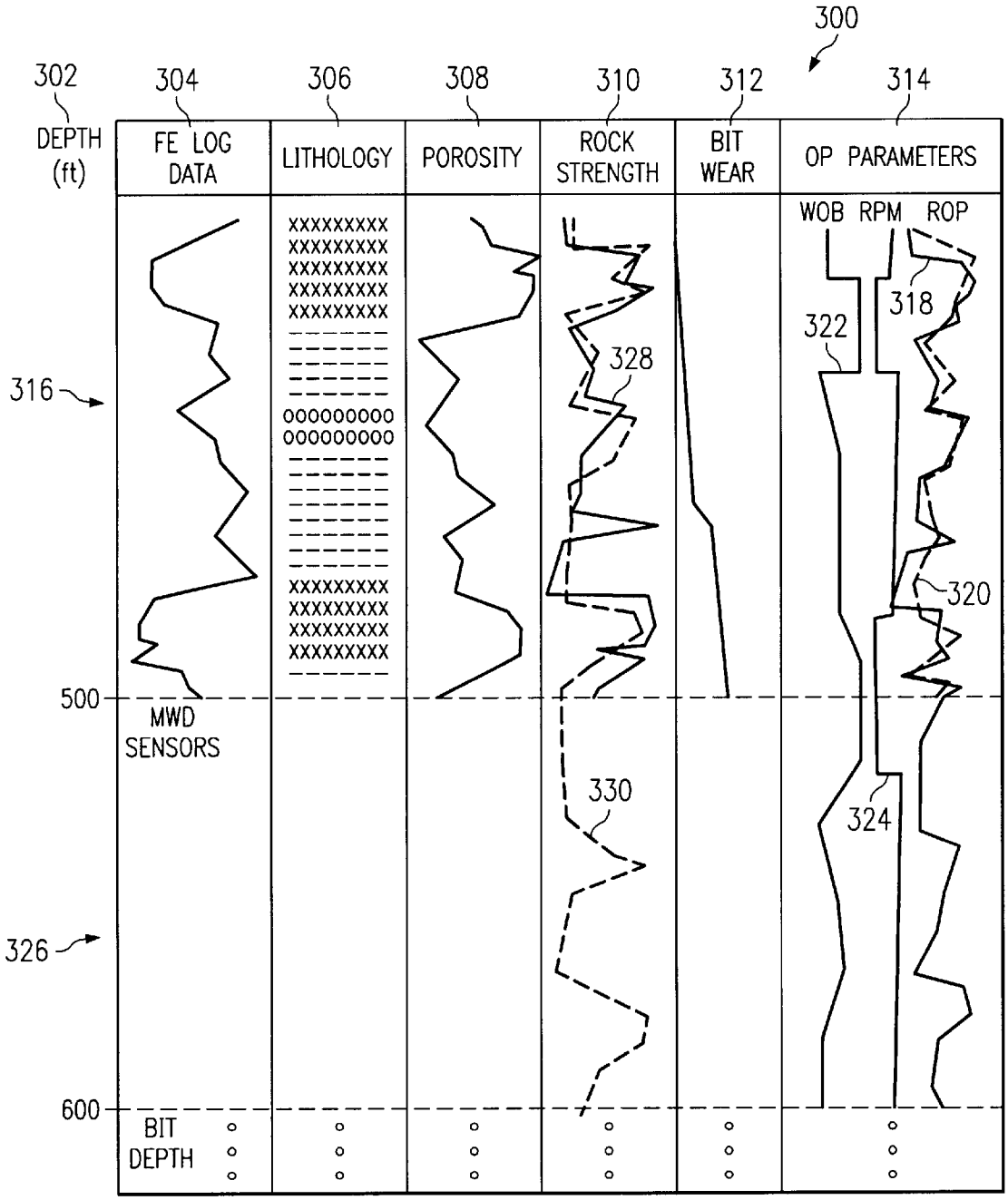
FIG. 5 illustrates an embodiment of an exemplary display of parameters and real-time aspects of the drilling prediction analysis and control system of the present disclosure.

With reference now to FIG. 5, a display 300 of the predicted performance of a drilling system for a given formation according to an embodiment of the present disclosure is shown, further in conjunction with the drilling prediction analysis and control system 50 of FIG. 1 previously described herein. Display 300 include plots of data versus depth, the data including depth 302, log data 304, lithology 306, porosity 308, rock strength 310, bit wear 312, and operation parameters 314. Data displayed for each respective plot is obtained as discussed earlier herein with respect to FIGS. 1–4 and as discussed below.

A first region 316 of the display 300 is characterized by information and data relating to respective depths above the depth location of MWD sensors. Such information in the first region 316 is considered essentially as accurate as if the data were collected and analyzed after the job was completed. Accordingly, the data of the first region 316 appears much like a "calibration mode" for an end-of-job case. The solid line 318 within the operating parameters column 314 denotes an actual ROP and the dashed line 320 represents what the prediction model would have predicted for ROP from the log-calculated rock strength 310 using actual drilling parameters (e.g., WOB 322 and RPM 324).

In an "end-of-job" mode, the drilling prediction analysis and control system compares the predicted versus actual ROP to assess the accuracy of the prediction model on the given well and to make adjustments as necessary for a subsequent well in the particular field or area. For a real time (RT) job, the drilling prediction analysis and control system 50 (FIG. 1) makes adjustments in the early drilling stages for a bit run in a given well bore, until a close history match is achieved to indicate that the prediction model is working well in the given environment. Accordingly, the drilling prediction analysis and control system is in a position to better predict future ROP's assuming there is good offset information. The better predicted future ROP's may help the drilling prediction analysis and control system determine when the bit will dull out and should be pulled in subsequent wells in the particular field.

Bit as a Measurement Tool

While the following example deals with a back-calculation of rock strength, it is possible to do a back calculation with respect to a different parameter as disclosed herein. Referring again to FIG. 5, a second region 326 is characterized by information and data corresponding to respective depths in the area between the bit and MWD sensors. The drilling parameter data (for example, WOB, RPM, and ROP) are known at the bit depth since they can be measured almost instantaneously. The drilling prediction analysis and control system 50 (FIG. 1) obtains a good ROP history match in the region 316 above the MWD sensors. Accordingly, the drilling prediction analysis and control system 50 is able to back-calculate some "implied" measurement parameter from the actual drilling parameters and a resultant ROP at a given depth or depths.

The "implied" parameter refers to a parameter (or parameters) that occurs within region 326 in the interval between the depths corresponding to the bit and MWD sensors, and accordingly, the "implied" parameter cannot be calculated from measured data, since the measurement device has not yet traversed the interval during a given period of time. After relevant MWD sensor data becomes available, the drilling prediction analysis and control system 50 can determine lithology and rock strength parameters therefrom. For example, the drilling prediction analysis and control system 50 can then compare an "implied" rock strength to a log-calculated rock strength. In FIG. 5, log-calculated rock strength is illustrated as a solid line 328 and the "implied" rock strength is illustrated as a dotted line 330.

The following discussion illustrates ways in which the drilling prediction analysis and control system 50 might make use of the above discussed technique of determining an "implied" parameter. If an "at-bit" measurement started deviating from a "verification" measurement, then the drilling prediction analysis and control system might imply that something has gone awry downhole. The bit may have been damaged or balled up, hole cleaning efficiency may be a problem, drilling efficiency may have changed, etc. There may also be instances in which the drilling prediction analysis and control system 50 uses implied parameter values for some other calculation, until a corresponding actual measured parameter value can be derived from log data, for example, as available in region 316.

When good offset data is available, the drilling prediction analysis and control system 50 can rely on it to help optimize the well being drilled. However, when drilling an exploration well with no offset information, the drilling prediction analysis and control system uses the "implied" data from the drilling well to optimize that well.

In other words, the values of the back calculated measurement parameters are history matched or compared with values of the measurement parameters. In a first instance, back calculated measurement parameters correspond to values in a first interval of the well bore above the level of the MWD sensors (such as region 316 of FIG. 5). With respect to back calculated values in this first interval, the drilling prediction analysis and control system performs a history match. One reason for the history match in this first interval is for the drilling prediction analysis and control system to determine whether or not the drilling mechanics model (models) is (are) working properly.

In the first interval, with respect to any deviation in the history match comparison that is greater than a prescribed amount, the drilling analysis and control system makes suitable adjustments to the drilling mechanics model used for generating the predicted drilling mechanics. In particular, the drilling prediction analysis and control system adjusts the underlying assumptions of a respective model until an acceptable level of deviation is achieved (i.e., until a history match deviation between the measurement parameter and the back calculated value of the measurement parameter are within an acceptable level of deviation).

Further in connection with the first interval, having made appropriate adjustments to one or more respective drilling mechanics models, the drilling analysis and control system improves a corresponding prediction of drilling mechanics for further drilling of the well bore. In other words, the drilling analysis and control system fine tunes the drilling mechanics models during the drilling process. In response, the drilling system alters control of one or more control parameters, as appropriate, based upon the fine tuned drilling mechanics model(s). Fine tuning helps in the optimization of drilling parameters as drilling of the well bore proceeds forward.

In a second instance, within a second interval of the well bore between the MWD measurement devices and the drill bit (such as region 326 of FIG. 5), the drilling prediction analysis and control system utilizes a history match of a measurement parameter to a back calculated value of the measurement parameter in a slightly different manner from the first interval. One reason for the history match in this second interval is for the drilling prediction analysis and control system to gain insight as to the condition of the bit and how the bit is interacting with the formation.

Within the second interval, if the history match reveals a deviation greater than a prescribed limit, then the deviation in the history match indicates a potential problem (e.g., at the bit) in the drilling of the well bore with the drilling system. Otherwise, a deviation in the history match within an acceptable limit indicates drilling of the well bore with the drilling system as predicted. With respect to the back calculated value of the measurement parameter within the second interval, the back calculated value is implied by actual parameters in the drilling the well bore (absent geological values) for the respective interval.

The real-time features as discussed herein provide a powerful addition to the drilling prediction analysis and control system capabilities.

Accordingly, the drilling system method and apparatus of the present disclosure may operate in a prescribed manner to implement a predictive mode, followed by a drilling mode. A comparison of parameters obtained in the predicted mode and parameters obtained in the drilling mode can provide useful insight with respect to modifying and/or making adjustments in connection with the prediction models and the drilling of a given well bore or a subsequent well bore. The drilling system method and apparatus also carries out a drilling optimization by examining real-time parameters in view of predicted parameters (e.g., a predicted rock strength) per unit depth and making appropriate adjustments (e.g., to the underlying assumptions used in the drilling mechanics model(s)).

The drilling prediction apparatus may be located at a location different from the actual drilling site. That is, the prediction apparatus may be at a remote location, interfacing with the actual drilling site via a global communications network, such as via the Internet or the like. The prediction apparatus may also reside at a real-time operation center (ROC), the ROC having a satellite link or other suitable communications link to the drilling site and drilling apparatus.

The present embodiment also facilitates usage of the prescribed bit as a measurement device during drilling of a well bore. With a formation change during the drilling of the well bore, such as the occurrence of a change in the compressive strength of rock, a corresponding change occurs in the response of the bit during the drilling of the well bore. For example, with a change in formation, the bit may become unbalanced, vibrate, or undergo other similar changes. The drilling system apparatus monitors such changes in bit performance using suitable measurement devices. For example, one way for monitoring bit performance is via a suitable sensor at the bit.

A sensor at the bit can also provide a means for mapping a given parameter of the borehole. For example, during the drilling of the well bore, the drilling system apparatus can compare a predicted lithology with a measured (or actual) lithology as a function of the measurement parameter at the bit. A suitable sensor placed within the bit or proximate the bit along the drill string may be used.

The drilling system apparatus may also include typical measurement while drilling (MWD) sensors located on the drill string behind the bit. For example, the MWD sensors are distal from the bit on the order of approximately 50–100 feet. As a result, measurements taken by the MWD sensors lag behind the bit in real-time during drilling of the well bore. With respect to the parameter of bit wear, the method of the present embodiment includes drilling of a well bore and while drilling, comparing a back calculated bit wear parameter (as determined from the MWD measurements) with the predicted bit wear parameter. The method further includes a build up of the bit wear condition in which measured bit wear is periodically updated in relation to the predicted wear, and appropriate adjustments are recommended and/or made for achieving an overall best drilling performance. In other words, the predicted wear performance can be compared with a real-time measured parameter that is representative of a measured bit wear performance.

The present embodiments furthermore facilitate a de facto same day "real time" optimization and calibration, as compared with an after-the-fact optimization and calibration on the order of one or more weeks. Real time optimization and calibration advantageously provides positive impact upon the drilling performance of the bit during drilling of a well bore. Accordingly, the drilling system and method of the present embodiments facilitate suitable parameter adjustments to better fit the real world scenario based upon results of a comparison (or history match) of actual versus predicted drilling parameters and performance.

When a discrepancy in an actual parameter versus a predicted parameter is uncovered (i.e., beyond a prescribed maximum amount), then the drilling system method and apparatus of the present embodiment operates in response thereto according to a prescribed response. For example, responsive to an evaluation of any history match deviations beyond a given limit, the drilling system and method may adjust various parameters as a function of the outcome of the comparison of actual versus predicted drilling performance. The comparison of actual versus predicted drilling parameters may provide an indication of adverse or undesired bit wear. A further assessment may provide an indication of whether or not the deviation is actually due to bit wear or some other adverse condition.

In an exemplary scenario, the drilling system may operate between an automatic drilling control mode and a manual control mode. In response to a history match discrepancy beyond a prescribed limit, the embodiment of the present disclosure can perform an alarm operation. An alarm operation may include the providing an indication that something is awry and that attention is needed. The system and method may also kick out of an automatic drilling control mode and place itself in the manual control mode until such time as the corresponding discrepancy is resolved.

The drilling system apparatus and method can also perform an alarm operation that includes suitable warning indicators, such as color coded indicators or other suitable indicators appropriate for a given display and/or field application. In a given alarm operation, prescribed information contained in the display may be highlighted, animated, etc. in a manner that draws attention to the corresponding information.

A red indicator may be provided, for example, representing that a potential for premature bit failure exists. Such premature bit failure may be deduced when a predicted parameter versus an actual parameter differ by more than a prescribed maximum differential amount. A yellow indicator may indicate a cautionary condition, wherein the predicted parameter versus actual parameter differ by more than a prescribed minimum differential amount but less than the maximum differential amount. Lastly, a green indicator may be indicative of an overall acceptable condition, wherein the predicted parameter versus actual parameter differ by less than a minimum differential amount. In the later instance, predicted versus actual is on course and drilling may proceed relatively undisturbed.

Accordingly, the present embodiments provide a form of alarm or early warning. A real-time decision to adjust or not adjust can then be rendered in a more informed manner that previously possible. The present embodiments further provide for real-time observation of the drilling of a well bore, e.g., utilizing the display.

In further discussion with respect to an actual versus predicted performance of a drill bit in the drilling of a well bore, it is noted that the bit is first in the bore hole prior to the logging tool. Real-time parameters at the bit are in advance of the logging tool by a given amount. The advance nature of the real-time parameters at the bit are in terms of time and distance, such time and distance corresponding to a time it takes the logging tool to traverse a corresponding distance that the logging tool is spaced from the bit along the drill string. With these real-time parameters, in conjunction with an appropriate drilling mechanics model, certain measurements can be implied such as a compressive strength of the rock being drilled by the bit. Other exemplary real-time parameters at the bit include WOB, RPM and torque.

With real-time parameter and measurement information, the drilling system apparatus uses logging while drilling instrumentation (such as MWD equipment) to verify what the bit implied, i.e., that what was implied was actually there or not. The MWD logging tool can be used for continually verifying what the bit implied, as further given by the predicted parameters and an actual performance. For example, if the logging tool is sensing parameters proportional to rock strength, the parameter information is sent to the drilling system prediction and analysis apparatus for processing. The prediction and analysis apparatus processes the pressure information by producing an indication of the true state of the rock being drilled. If the true state of the rock is as predicted, then the drilling process is allowed to proceed. If not, then the drilling process may be altered or modified as appropriate. Accordingly, the drilling prediction and analysis system can control the drilling of the well bore in a prescribed manner. One prescribed manner might include alternating between an automatic drilling control mode and a manual drilling control mode.

Another exemplary MWD tool includes a bit vibration measurement tool. Based upon vibration data, the drilling prediction and analysis system makes a determination of whether or not a given bit down hole sustained bit damage. An inflection point that may occur within the vibration measurement tool output data is indicative that a calibration or updating of the vibration level may be necessary. Using a bit parameter optimization based upon vibration data, the drilling prediction and analysis system determines how much force a given bit can sustain without incurring significant or catastrophic damage. Such an analysis may include the use of performance data derived from prior bit vibration/performance studies. As discussed herein, the drilling prediction and analysis system includes at least one computer readable medium having suitable programming code for carrying out the functions as discussed herein.

The present invention also relates to an examination of bore hole stability concerns. Using appropriate characterizations, bore hole mapping can be conducted for assaying any cracks in a given formation. The orientation of cracks in the formation can have an impact upon drillability. Mapping of fractures or cracks may provide some indication of the extent that the rock is damaged. A fracture is an indication of the existence of a rapid drop in rock strength.

It is also important to keep in mind error minimization. There are many unknowns. To apportion error to some cause may be incorrect, unless some direct quantization exists. This relates to inference versus measurement. Using suitable measurement while drilling apparatus, various log data can be routed to the surface. There can be many measurements downhole, however, only selected ones are able to be sent to the surface. Such a limitation is due mostly to an inability in current technology to transport all of the possible measurements to the surface at once.

The drilling system apparatus and method of the present embodiments also makes use of the bit as a measurement tool. For example, a vibrational harmonic of the bit enables usage of the bit as a measurement tool. Vibrational data may prove useful for calibration purposes. In an example of the drilling of a well bore, the bit can be specified, taking into consideration available data regarding the particular lithology and for specifying various parameters of WOB, torque and ROP. The method includes drilling the well and monitoring ROP, observing lithology, and determining WOB as part of the process. In this example, the bit is the first measurement device to start predicting what is being drilled, and the various logging tools verify bit measurements.

The present method and system apparatus further includes back calculation of parameters, overlaying of the back calculated parameters with the predicted parameters, and assessing what is actually happening. The method and system apparatus then fine tune and/or make appropriate adjustments in response to the determination of what is actually happening at the bit. Accordingly, with the bit as a measurement tool, an advance notice, on the order of 50–100 feet, is possible for assaying what is happening downhole at the bit.

In addition, using the bit as a measurement tool, one can assay whether or not the bit is still alive (i.e., able to continue drilling) or other appropriate assessment. For example, the bit measurement may indicate that the bit did something unexpected. A MWD sensor on the drill string can verify what the bit measurement indicated. Was the MWD sensor earlier or later than expected? What is the appropriate action to take? Is there a fault? Using the bit as a sensor, the prediction and analysis system is able to observe and/or measure vibration for indicating whether or not the bit performs as predicted. Accordingly, the prediction and analysis system can update recommended drilling parameters based upon what is observed using the bit as a measurement tool. For a look ahead application (e.g., one foot ahead of the bit), the prediction and analysis apparatus can adjust parameters to where the drilling apparatus is expected to be, in conjunction with using the bit as a measurement tool.

Using the bit as a measurement tool, the prediction and analysis system can assay an anisotropy of the rock, directional characteristics, compressive strength, and/or porosity. For a horizontal well, there is a need for the drill to go 90 degrees from vertical. If the relative dip angle changes, the porosity may still be the same.

In a history matching mode or optimization mode, the MWD sensor or sensors can be 50 to 100 feet behind the bit, at the bit, or measuring ahead of bit. In one mode of operation, the system generates a proposal and utilizes the proposal during drilling of a well bore. For example, the proposal may include a lithology and a predicted rock strength per unit depth. During drilling, the system back calculates to the rock strength at a given depth, then compares the back calculated measure of rock strength to information available in response to the measurement tool crossing a corresponding boundary (i.e., passes the formation). The system then performs a history match of predicted rock strength and actual rock strength. Subsequent to the history match, the system makes an appropriate parameter adjustment or adjustments.

The system conducts history matching to verify or determine that the drilling system is responding as it was predicted that it would respond at the bit. The system further operates in a real time mode utilizing the display mechanics and back calculations of effective rock strength (predicted). As a sensor traverses by a given depth, the system calculates a compressive rock strength (or porosity) parameter. A mud logger may be used in conjunction with a measured rock strength vs. predicted rock strength calibration, wherein the mud logger is suitably calibrated prior to usage.

As discussed herein, the drilling prediction analysis and control system utilizes data that is closer to the bit. Accordingly, the system and method render any previous uncertainties much smaller. With respect to the drilling of a well bore, this is an improvement. Based upon experience, it is common for an unexpected geology scenario to occur in offset wells.

According to the present embodiments, real-time can be characterized by a collapsing of time between when data is acquired down hole and when that data is available to the drilling operator at a given moment. That is, how long will it be before the drilling operator gets data (2 weeks vs. 1 day). With the real-time aspect of the drilling prediction analysis and control system, the system is able to determine what the bit is doing within a short period of time, determine what needs to be adjusted, and outputs a revised WOB, RPM, or other appropriate operating parameter(s) in real-time.

With respect to bit wear, the drilling analysis and control system includes a bit wear indicator. The bit wear indicator is characterized in that as the bit wears, a signature or acoustic signal is generated that is different for different states of bit wear. The system also includes, via suitable measurement devices, an ability to measure the signature or acoustic signal for determining a measurement of the wear condition of the bit.

As discussed herein, operating parameters include at least a predicted RPM, WOB, COST, ROP, and ROP-avg. These predicted operating parameters are displayed on the display output of the drilling prediction analysis and control system 50 of FIG. 1. Measurement parameters can include any parameter associated with the drilling of a well bore that can be measured or obtained (such as by appropriate calculations) in real time. A measurement parameter can include one or more operating parameters. Control parameters can include any parameters subject to being modified or controlled, either manually or via automatic control, to affect or alter the drilling of a well bore. For example, control parameters may include one or more operating parameters that are subject to direct (or indirect) control.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. An apparatus for predicting the performance of a drilling system for the drilling of a well bore in a given formation, said apparatus comprising:

means for generating a geology characteristic of the formation per unit depth according to a prescribed geology model and outputting signals representative of the geology characteristic, the geology characteristic including at least rock strength;

means for inputting specifications of proposed drilling equipment for use in the drilling of the well bore, the specifications including at least a bit specification of a recommended drill bit;

means for determining a predicted drilling mechanics in response to the specifications of the proposed drilling equipment as a function of the geology characteristic per unit depth according to a drilling mechanics model and outputting signals representative of the predicted drilling mechanics, the predicted drilling mechanics including at least one of the following selected from the group consisting of bit wear, mechanical efficiency, power, and operating parameters;

means responsive to a predicted drilling mechanics output signal for controlling a control parameter in drilling of the well bore with the drilling system, the control parameter including at least one selected from the group consisting of weight-on-bit, rpm, pump flow rate, and hydraulics;

means for obtaining a measurement parameter in real time during the drilling of the well bore; and means for history matching the measurement parameter with a back calculated value of the measurement parameter, wherein the back calculated value of the measurement parameter is a function of the drilling mechanics model and at least one control parameter, and wherein responsive to a prescribed deviation between the measurement parameter and the back calculated value of the measurement parameter, said control means performs at least one of the following selected from the group consisting of a) adjusts the drilling mechanics model, b) modifies control of a control parameter, and c) performs an alarm operation.

2. The apparatus of claim 1, further comprising:

means responsive to the geology characteristic output signals and the predicted drilling mechanics output signals for generating a display of the geology characteristic and predicted drilling mechanics per unit depth.

3. The apparatus of claim 2, wherein said display generating means includes at least one of the following selected from the group consisting of a) a display monitor and b) a printer, wherein the display of the geology characteristic and predicted drilling mechanics per unit depth includes a print-out.

4. The apparatus of claim 1, wherein said geology characteristic generating means further generates at least one of the following additional characteristics selected from the group consisting of log data, lithology, porosity, and shale plasticity.

5. The apparatus of claim 1, wherein said proposed drilling equipment input specification means further includes inputting at least one additional specification of proposed drilling equipment selected from the group consisting of down hole motor, top drive motor, rotary table motor, mud system, and mud pump.

6. The apparatus of claim 1, wherein the operating parameters include at least one of the following selected from the group consisting of weight-on-bit, rotary rpm (revolutions-per-minute), cost, rate of penetration, and torque.

7. The apparatus of claim 6, further wherein rate of penetration includes instantaneous rate of penetration (ROP) and average rate of penetration (ROP-AVG).

8. The apparatus of claim 2, wherein the display of the geology characteristic includes at least one graphical representation selected from the group consisting of a curve representation, a percentage graph representation, and a band representation, and the display of the predicted drilling mechanics includes at least one graphical representation selected from the group consisting of a curve representation, a percentage graph representation, and a band representation.

9. The apparatus of claim 8, wherein said display generating means includes at least one of the following selected from the group consisting of a) a display monitor and b) a printer, wherein the display of the geology characteristic and predicted drilling mechanics per unit depth includes a printout.

10. The apparatus of claim 8, further wherein the at least one graphical representation of the geology characteristic and the at least one graphical representation of the predicted drilling mechanics are color coded.

11. The apparatus of claim 8, wherein rock strength is expressed in the form of at least one of the following representations selected from the group consisting of a curve representation, a percentage graph representation, and a band representation, wherein the curve representation of rock strength includes confined rock strength and unconfined rock strength, further wherein an area between respective curves of confined rock strength and unconfined rock strength is graphically illustrated and represents an increase in rock strength as a result of a confining stress, and the band representation of rock strength provides a graphical illustration indicative of a discrete range of rock strength at a given depth, further wherein the band representation of the rock strength is coded, including a first code representative of a soft rock strength range, a second code representative of a hard rock strength range, and additional codes representative of one or more intermediate rock strength ranges.

12. The apparatus of claim 8, wherein said geology characteristic generating means further generates at least one of the following additional characteristics selected from the group consisting of log data, lithology, porosity, and shale plasticity, and the operating parameters include at least one of the following selected from the group consisting of weight-on-bit, bit rpm (revolutions-per-minute), cost, rate of penetration, and torque.

13. The apparatus of claim 12, wherein log data is expressed in the form of a curve representation, the log data including any log suite sensitive to lithology and porosity, and lithology is expressed in the form of a percentage graph for use in identifying different types of rock within the given formation, the percentage graph illustrating a percentage of each type of rock at a given depth, and porosity is expressed in the form of a curve representation, and shale plasticity is expressed in the form of at least one of the following representations selected from the group consisting of a curve representation, a percentage graph representation, and a band representation, wherein the curve representation of shale plasticity includes at least one curve of shale plasticity parameters selected from the group consisting of water content, clay type, and clay volume, further wherein shale plasticity is determined from water content, clay type, and clay volume according to a prescribed shale plasticity model, and the band representation of the shale plasticity provides a graphical illustration indicative of a discrete range of shale plasticity at a given depth, further wherein the band representation of the shale plasticity is coded, including a first code representative of a low shale plasticity range, a second code representative of a high shale plasticity range, and additional codes representative of one or more intermediate shale plasticity ranges.

14. The apparatus of claim 8, wherein bit wear is determined as a function of cumulative work done according to a prescribed bit wear model and expressed in the form of at least one of the following representations selected from the group consisting of a curve representation and a percentage graph representation, wherein the curve representation of bit wear may include bit work expressed as specific energy level at the bit, cumulative work done by the bit, and optional work losses due to abrasivity, and the percentage graph representation is indicative of a bit wear condition at a given depth, further wherein the percentage graph of bit wear is coded, including a first code representative of expired bit life, and a second code representative of remaining bit life.

15. The apparatus of claim 8, wherein bit mechanical efficiency is determined as a function of a torque/weight-on-bit signature for the given bit according to a prescribed mechanical efficiency model and expressed in the form of at least one of the following representations selected from the group consisting of a curve representation and a percentage graph representation, wherein the curve representation of bit mechanical efficiency includes total torque and cutting torque at the bit, and the percentage graph representation of bit mechanical efficiency graphically illustrates total torque, total torque including cutting torque and frictional torque components, further wherein the percentage graph representation of bit mechanical efficiency is coded, including a first code for illustrating cutting torque, a second code for illustrating frictional unconstrained torque, and a third code for illustrating frictional constrained torque.

16. The apparatus of claim 15, wherein mechanical efficiency is further represented in the form of a percentage graph illustrating drilling system operating constraints that have an adverse impact upon mechanical efficiency, the drilling system operating constraints corresponding to constraints that result in an occurrence of frictional constrained torque, the percentage graph further for indicating a corresponding percentage of impact that each constraint has upon the frictional constrained torque component of the mechanical efficiency at a given depth, wherein the drilling system operating constraints can include maximum torque-on-bit (TOB), maximum weight-on-bit (WOB), minimum and maximum bit revolutions-per-minute (RPM), maximum penetration rate (ROP), in any combination, and an unconstrained condition, further wherein the percentage graph representation of drilling system operating constraints on mechanical efficiency is coded, including different codes for identifying different constraints.

17. The apparatus of claim 8, wherein power is expressed in the form of at least one of the following representations selected from the group consisting of a curve representation and a percentage graph representation, wherein the curve representation for power includes power limit and operating power level, the power limit corresponding to a maximum power to be applied to the bit and the operating power level including at least one of the following selected from the group consisting of constrained operating power level, recommended operating power level, and predicted operating power level, and the percentage graph representation of power illustrates drilling system operating constraints that have an adverse impact upon power, the drilling system operating constraints corresponding to those constraints that result in a power loss, the power constraint percentage graph further for indicating a corresponding percentage of impact that each constraint has upon the power at a given depth, further wherein the percentage graph representation of drilling system operating constraints on power is coded, including different codes for identifying different constraints.

18. The apparatus of claim 2, further comprising:

means for generating a display of details of proposed drilling equipment along with the geology characteristic and predicted drilling mechanics, the proposed drilling equipment including at least one recommended bit selection used in predicting the performance of the drilling system.

19. The apparatus of claim 18, wherein first and second bit selections are recommended for use in a predicted performance of the drilling of the well bore, further wherein the first and second bit selections are identified with respective first and second identifiers, the first and second identifiers being displayed with the geology characteristic and predicted drilling mechanics, further wherein the positioning of the first and second identifiers on the display is selected to correspond with portions of the predicted performance to which the first and second bit selections apply, respectively.

20. The apparatus of claim 2, further comprising:

a bit selection change indicator for indicating that a change in bit selection from a first recommended bit selection to a second recommended bit selection is required at a given depth on the display of geology characteristics and predicted drilling mechanics.

21. An method for predicting the performance of a drilling system for the drilling of a well bore in a given formation comprising:

generating a geology characteristic of the formation per unit depth according to a prescribed geology model and outputting signals representative of the geology characteristic, the geology characteristic including at least rock strength;

obtaining specifications of proposed drilling equipment for use in the drilling of the well bore, the specifications including at least a bit specification of a recommended drill bit;

determining a predicted drilling mechanics in response to the specifications of the proposed drilling equipment as a function of the geology characteristic per unit depth according to a drilling mechanics model and outputting signals representative of the predicted drilling mechanics, the predicted drilling mechanics including at least one of the following selected from the group consisting of bit wear, mechanical efficiency, power, and operating parameters;

controlling a control parameter in drilling of the well bore with the drilling system in response to a predicted drilling mechanics output signal, the control parameter including at least one selected from the group consisting of weight-on-bit, rpm, pump flow rate, and hydraulics;

obtaining a measurement parameter in real time during the drilling of the well bore; and history matching the measurement parameter with a back calculated value of the measurement parameter, wherein the back calculated value of the measurement parameter is a function of at least one of the following selected from the group consisting of the drilling mechanics model and at least one control parameter, and responsive to a prescribed deviation between the measurement parameter and the back calculated value of the measurement parameter, said controlling step further for performing at least one of the following selected from the group consisting of a) adjusting the drilling mechanics model, b) modifying control of a control parameter, and c) performing an alarm operation.

22. The method of claim 21, further comprising:

generating a display of the geology characteristic and predicted drilling mechanics per unit depth in response to the geology characteristic output signals and the predicted drilling mechanics output signals.

23. The method of claim 22, wherein generating a display includes using at least one of the following selected from the group consisting of a) a display monitor and b) a printer, wherein the display of the geology characteristic and predicted drilling mechanics per unit depth includes a printout.

24. The method of claim 21, wherein generating the geology characteristic includes generating at least one of the following additional characteristics selected from the group consisting of log data, lithology, porosity, and shale plasticity.

25. The method of claim 21, wherein obtaining the proposed drilling equipment input specifications further includes obtaining at least one additional specification of proposed drilling equipment selected from the group consisting of down hole motor, top drive motor, rotary table motor, mud system, and mud pump.

26. The method of claim 21, wherein the operating parameters include at least one of the following selected from the group consisting of weight-on-bit, bit rpm (revolutions-per-minute), cost, rate of penetration, and torque.

27. The method of claim 26, further wherein rate of penetration includes instantaneous rate of penetration (ROP) and average rate of penetration (ROP-AVG).

28. The method of claim 22, wherein displaying the geology characteristic includes displaying at least one graphical representation selected from the group consisting of a curve representation, a percentage graph representation, and a band representation, and displaying the predicted drilling mechanics includes displaying at least one graphical representation selected from the group consisting of a curve representation, a percentage graph representation, and a band representation.

29. The method of claim 28, wherein generating a display includes using at least one of the following selected from the group consisting of a) a display monitor and b) a printer, wherein the display of the geology characteristic and predicted drilling mechanics per unit depth includes a printout.

30. The method of claim 28, further wherein the at least one graphical representation of the geology characteristic and the at least one graphical representation of the predicted drilling mechanics are color coded.

31. The method of claim 28, wherein rock strength is expressed in the form of at least one of the following representations selected from the group consisting of a curve representation, a percentage graph representation, and a band representation, wherein the curve representation of rock strength includes confined rock strength and unconfined rock strength, further wherein an area between respective curves of confined rock strength and unconfined rock strength is graphically illustrated and represents an increase in rock strength as a result of a confining stress, and the band representation of rock strength provides a graphical illustration indicative of a discrete range of rock strength at a given depth, further wherein the band representation of the rock strength is coded, including a first code representative of a soft rock strength range, a second code representative of a hard rock strength range, and additional codes representative of one or more intermediate rock strength ranges.

32. The method of claim 28, wherein generating the geology characteristic further includes generating at least one of the following additional characteristics selected from the group consisting of log data, lithology, porosity, and shale plasticity, and the operating parameters include at least one of the following selected from the group consisting of weight-on-bit, bit rpm (revolutions-per-minute), cost, rate of penetration, and torque.

33. The method of claim 32, wherein log data is expressed in the form of a curve representation, the log data including any log suite sensitive to lithology and porosity, lithology is expressed in the form of a percentage graph for use in identifying different types of rock within the given formation, the percentage graph illustrating a percentage of each type of rock at a given depth, porosity is expressed in the form of a curve representation, and shale plasticity is expressed in the form of at least one of the following representations selected from the group consisting of a curve representation, a percentage graph representation, and a band representation, wherein the curve representation of shale plasticity includes at least one curve of shale plasticity parameters selected from the group consisting of water content, clay type, and clay volume, further wherein shale plasticity is determined from water content, clay type, and clay volume according to a prescribed shale plasticity model, and the band representation of the shale plasticity provides a graphical illustration indicative of a discrete range of shale plasticity at a given depth, further wherein the band representation of the shale plasticity is coded, including a first code representative of a low shale plasticity range, a second code representative of a high shale plasticity range, and additional codes representative of one or more intermediate shale plasticity ranges.

34. The method of claim 28, wherein bit wear is determined as a function of cumulative work done according to a prescribed bit wear model and expressed in the form of at least one of the following representations selected from the group consisting of a curve representation and a percentage graph representation, wherein the curve representation of bit wear may include bit work expressed as specific energy level at the bit, cumulative work done by the bit, and optional work losses due to abrasivity, and the percentage graph representation is indicative of a bit wear condition at a given depth, further wherein the percentage graph representation of bit wear is coded, including a first code representative of expired bit life, and a second code representative of remaining bit life.

35. The method of claim 28, wherein bit mechanical efficiency is determined as a function of a torque/weight-on-bit signature for the given bit according to a prescribed mechanical efficiency model and expressed in the form of at least one of the following representations selected from the group consisting of a curve representation and a percentage graph representation, wherein the curve representation of bit mechanical efficiency includes total torque and cutting torque at the bit, and the percentage graph representation of bit mechanical efficiency graphically illustrates total torque, total torque including cutting torque and frictional torque components, further wherein the percentage graph representation of bit mechanical efficiency is coded, including a first code for illustrating cutting torque, a second code for illustrating frictional unconstrained torque, and a third code for illustrating frictional constrained torque.

36. The method of claim 35, wherein mechanical efficiency is further represented in the form of a percentage graph illustrating drilling system operating constraints that have an adverse impact upon mechanical efficiency, the drilling system operating constraints corresponding to constraints that result in an occurrence of frictional constrained torque, the percentage graph further for indicating a corresponding percentage of impact that each constraint has upon the frictional constrained torque component of the mechanical efficiency at a given depth, wherein the drilling system operating constraints can include maximum torque-on-bit (TOB), maximum weight-on-bit (WOB), minimum and maximum bit revolutions-per-minute (RPM), maximum penetration rate (ROP), in any combination, and an unconstrained condition, and the percentage graph representation of drilling system operating constraints on mechanical efficiency is coded, including different codes for identifying different constraints.

37. The method of claim 28, wherein power is expressed in the form of at least one of the following representations selected from the group consisting of a curve representation and a percentage graph representation, wherein the curve representation for power includes power limit and operating power level, the power limit corresponding to a maximum power to be applied to the bit and the operating power level including at least one of the following selected from the group consisting of constrained operating power level, recommended operating power level, and predicted operating power level, and the percentage graph representation of power illustrates drilling system operating constraints that have an adverse impact upon power, the drilling system operating constraints corresponding to those constraints that result in a power loss, the power constraint percentage graph further for indicating a corresponding percentage of impact that each constraint has upon the power at a given depth, further wherein the percentage graph representation of drilling system operating constraints on power is coded, including different codes for identifying different constraints.

38. The method of claim 22, further comprising:

generating a display of details of proposed drilling equipment along with the geology characteristic and predicted drilling mechanics, the proposed drilling equipment including at least one recommended bit selection used in predicting the performance of the drilling system.

39. The method of claim 38, wherein first and second bit selections are recommended for use in a predicted performance of the drilling of the well bore, further wherein the first and second bit selections are identified with respective first and second identifiers, the first and second identifiers being displayed with the geology characteristic and predicted drilling mechanics, further wherein the positioning of the first and second identifiers on the display is selected to correspond with portions of the predicted performance to which the first and second bit selections apply, respectively.

40. The method of claim 22, further comprising:

indicating that a change in bit selection from a first recommended bit selection to a second recommended bit selection is required at a- given depth on the display of geology characteristics and predicted drilling mechanics.

41. A computer program stored on a computer-readable medium for execution by a computer for predicting the performance of a drilling system in the drilling of a well bore of a given formation, said computer program comprising:

instructions for generating a geology characteristic of the formation per unit depth according to a prescribed geology model and outputting signals representative of the geology characteristic, the geology characteristic including at least rock strength;

instructions for obtaining specifications of proposed drilling equipment for use in the drilling of the well bore, the specifications including at least a bit specification of a recommended drill bit;

instructions for determining a predicted drilling mechanics in response to the specifications of the proposed drilling equipment as a function of the geology characteristic per unit depth according to a drilling mechanics model and outputting signals representative of the predicted drilling mechanics, the predicted drilling mechanics including at least one of the following selected from the group consisting of bit wear, mechanical efficiency, power, and operating parameters;

instructions for controlling a control parameter in drilling of the well bore with the drilling system in response to a predicted drilling mechanics output signal, the control parameter including at least one selected from the group consisting of weight-on-bit, rpm, pump flow rate, and hydraulics;

instructions for obtaining a measurement parameter in real time during the drilling of the well bore; and instructions for history matching the measurement parameter with a back calculated value of the measurement parameter, wherein the back calculated value of the measurement parameter is a function of at least one of the following selected from the group consisting of the drilling mechanics model and at least one control parameter, and said instructions for controlling the control parameter further including instructions, responsive to a prescribed deviation between the measurement parameter and the back calculated value of the measurement parameter, for performing at least one of the following selected from the group consisting of a) adjusting the drilling mechanics model, b) modifying control of a control parameter, and c) performing an alarm operation.

42. The computer program of claim 41, further comprising:

instructions for generating a display of the geology characteristic and predicted drilling mechanics per unit depth in response to the geology characteristic output signals and the predicted drilling mechanics output signals.

43. The computer program of claim 42, wherein generating a display includes using at least one of the following selected from the group consisting of a) a display monitor and b) a printer, wherein the display of the geology characteristic and predicted drilling mechanics per unit depth includes a printout.

44. The computer program of claim 41, wherein generating the geology characteristic includes generating at least one of the following additional characteristics selected from the group consisting of log data, lithology, porosity, and shale plasticity.

45. The computer program of claim 41, wherein obtaining the proposed drilling equipment input specifications further includes obtaining at least one additional specification of proposed drilling equipment selected from the group consisting of down hole motor, top drive motor, rotary table motor, mud system, and mud pump.

46. The computer program of claim 41, wherein the operating parameters include at least one of the following selected from the group consisting of weight-on-bit, bit rpm (revolutions-per-minute), cost, rate of penetration, and torque.

47. The computer program of claim 46, further wherein rate of penetration includes instantaneous rate of penetration (ROP) and average rate of penetration (ROP-AVG).

48. The computer program of claim 42, wherein displaying the geology characteristic includes displaying at least one graphical representation selected from the group consisting of a curve representation, a percentage graph representation, and a band representation, and displaying the predicted drilling mechanics includes displaying at least one graphical representation selected from the group consisting of a curve representation, a percentage graph representation, and a band representation.

49. The computer program of claim 48, wherein generating a display includes using at least one of the following selected from the group consisting of a) a display monitor and b) a printer, wherein the display of the geology characteristic and predicted drilling mechanics per unit depth includes a printout.

50. The computer program of claim 48, further wherein the at least one graphical representation of the geology characteristic and the at least one graphical representation of the predicted drilling mechanics are color coded.

* * * * *